US007499656B2

(12) United States Patent
Kimura et al.

(10) Patent No.: US 7,499,656 B2
(45) Date of Patent: Mar. 3, 2009

(54) REMAINING AMOUNT OF TONER DETECTING APPARATUS, TONER CARTRIDGE AND IMAGE FORMING APPARATUS

(75) Inventors: Takahiko Kimura, Ikoma (JP); Takeshi Wakabayashi, Soraku-gun (JP); Teruyoshi Sudoh, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 486 days.

(21) Appl. No.: 10/549,697

(22) PCT Filed: Mar. 18, 2004

(86) PCT No.: PCT/JP2004/003685

§ 371 (c)(1),
(2), (4) Date: Sep. 19, 2005

(87) PCT Pub. No.: WO2004/083965

PCT Pub. Date: Sep. 30, 2004

(65) Prior Publication Data

US 2006/0198643 A1 Sep. 7, 2006

(30) Foreign Application Priority Data

Mar. 19, 2003 (JP) ..... 2003-076150

(51) Int. Cl.
*G03G 15/08* (2006.01)

(52) U.S. Cl. ..... 399/27; 399/61; 399/62; 399/63

(58) Field of Classification Search ..... 399/61, 399/62, 63, 24, 27, 272
See application file for complete search history.

(56) References Cited

U.S. PATENT DOCUMENTS 5,035,198 A * 7/1991 Niito ..... 399/27

(Continued)

FOREIGN PATENT DOCUMENTS

JP 60-51858 A 3/1985

(Continued)

*Primary Examiner*—David M Gray
*Assistant Examiner*—Ryan D Walsh
(74) *Attorney, Agent, or Firm*—Birch, Stewart, Kolasch & Birch, LLP

(57) ABSTRACT

An object of the present invention is to provide a remaining amount of toner detecting apparatus capable of highly accurately detecting the remaining amount of toner with a simple configuration, a toner cartridge in which the remaining amount of toner is highly accurately detected with a simple configuration, and an image forming apparatus which enables the operator to easily recognize time to resupply toner and is capable of forming an image of high image quality. A holding member (22) is flexible, one end (22*a*) in the longitudinal direction is connected to a stirring member (11), and the other end (22*b*) in the longitudinal direction holds a detection auxiliary member (21) disposed in a housing (8). Consequently, the holding member (22) and the detection auxiliary member (21) rotate as the stirring member (11) rotates. Moreover, as to the detection auxiliary member (21), since the holding member (22) is flexible, the rotation radius of the detection auxiliary member (21) changes in response to the reference amount of toner (7). A detecting component (2) detects the distance to the detection auxiliary member (21) that changes in response to the amount of the toner (7) in the housing (8), and a CPU (24) calculates the remaining amount of the toner (7).

17 Claims, 18 Drawing Sheets

U.S. PATENT DOCUMENTS

| | | | | |
|---|---|---|---|---|
| 5,436,704 | A * | 7/1995 | Moon | 399/256 |
| 5,539,502 | A | 7/1996 | Koshino et al. | |
| 2007/0058995 | A1 * | 3/2007 | Onda et al. | 399/27 |

FOREIGN PATENT DOCUMENTS

| | | | |
|---|---|---|---|
| JP | 62-115484 | A | 5/1987 |
| JP | 1-32049 | Y2 | 10/1989 |
| JP | 2-280176 | A | 11/1990 |
| JP | 3-220576 | A | 9/1991 |
| JP | 8-123180 | A | 5/1996 |
| JP | 9-80891 | A | 3/1997 |
| JP | 9-197797 | A | 7/1997 |
| JP | 2001-109248 | A | 4/2001 |

* cited by examiner

REMAINING AMOUNT OF TONER DETECTING APPARATUS, TONER CARTRIDGE AND IMAGE FORMING APPARATUS

TECHNICAL FIELD

The present invention relates to a remaining amount of toner detecting apparatus which detects the remaining amount of toner stored in a housing, a toner cartridge equipped with the remaining amount of toner detecting apparatus, and an image forming apparatus in which the toner cartridge is installed.

In the present description, a term "rotation" includes angular displacements of less than 360 degrees and rotations of 360 degrees or more.

BACKGROUND ART

An electrophotographic image forming apparatus which uses a two-component developer composed of toner and a carrier exercises control to keep a constant toner density at all times by detecting the two-component developer in a developing portion with a permeability sensor and, when the density thereof becomes low, resupplying toner to the developer from a toner cartridge having a housing in which the toner is stored. In this control, in the case where a condition that the toner density is lower than a predetermined reference density continues for a specified time or more, the apparatus determines that there is no toner in the housing, gives a warning that there is no toner in the housing to the operator, and urges the operator to replenish the image forming apparatus with toner.

In this control, however, since notification representing that toner is exhausted is suddenly performed, the operator takes time to prepare for replenishment with toner and replacement of the toner cartridge, which results in that the image forming apparatus cannot be used for a long period during this replenishing operation. Accordingly, a technique for making it possible to securely detect the remaining amount of toner in the housing of the toner cartridge is required.

A first related art of such a technique is a copying machine equipped with a permeability sensor which detects the permeability of a developer supplied from the developing portion to a photoreceptor drum and an optical density sensor which detects the surface density of the photoreceptor drum subjected to development by the developing portion {refer to Japanese Unexamined Patent Publication JP-A 2-280176 (1990), for example}. In this copying machine, by the use of both the two sensors of different kinds, that is, the permeability sensor and the optical density sensor, the remaining amount of toner in the toner cartridge storing the toner is detected based on the toner density of the developer supplied from the developing portion to the photoreceptor drum and the surface density of the photoreceptor drum.

Further, such a method can be considered as to determine that the reference amount of toner remaining in the toner cartridge is small or the toner is exhausted in the case where toner supplying means which supplies toner to the developing portion operates for a specified time or more. However, a wide variation exists in the supply reference amount per unit time of the toner supplying means among the individual image forming apparatuses, and there is a possibility that the variation results in errors in determination that the reference amount of toner remaining in the toner cartridge is small or the toner is exhausted. As a result, there is a possibility of incorrect determination that the remaining amount of toner is small or the toner is exhausted though a sufficient reference amount of toner remains in the toner cartridge, and contrarily, incorrect determination that toner remains sufficiently though toner in the toner cartridge is exhausted and an image formed on a recording sheet becomes lighter.

A second related art to avoid incorrect determination resulting from a variation in the toner supply reference amount per unit time of the toner supplying means among the individual image forming apparatuses as described above as far as possible is an image forming apparatus which detects the density of a developed image on the photoreceptor drum and, in the case where the detected image density is lower than a specified reference value, operates the toner supplying means {refer to Japanese Unexamined Patent Publication JP-A 9-197797 (1997), for example}. Consequently, based on the ratio between an operation time of the toner supplying means when the density of an image developed on the photoreceptor drum becomes the reference value or more and an operation time of the toner supplying means when the toner supply reference amount is the maximum, that is, based on the maximum resupply rate, the toner supply reference amount by the toner supplying means is regulated. Accordingly, it becomes possible to detect the reference amount of toner remaining in the toner cartridge.

FIG. 18 is a cross section view showing a toner cartridge 100 of a third related art. In the toner cartridge 100, a rotation axis 102 is provided in a storing space 101 that stores toner 200, so as to be capable of rotating around an axial line thereof L102. To the rotation axis 102, one end of a rotating portion 103 is connected. The rotating portion 103 is flexible and, to the other end, a permanent magnet piece 104 is disposed. When the rotation axis 102 rotates, the permanent magnet piece 104 of the rotating portion 103 also rotates around an axial line L101. To the external wall portion of a housing 105 of the toner cartridge 100, a magnetism detecting switch 106 is disposed.

Since the rotating portion 103 is flexible, the rotating portion bends meeting with resistance from the toner 200 while rotating around the axial line L102. A resistance force with which the rotating portion 103 meets from the toner 200 while rotating changes in response to the amount of the toner 200 stored in the storing space 101. Therefore, a movement path of the permanent magnetic piece 104 changes in response to the amount of the toner 200. For example, when the amount of the toner 200 in the toner cartridge 100 is large, the movement path becomes like a curved line C1 shown by a broken line in FIG. 18. When the amount of the toner 200 in the toner cartridge 100 becomes small, a resistance force with which the rotating portion 103 meets from the toner 200 becomes small, so that the bent rotating portion 103 is straightened linearly. Consequently, the movement path of the permanent magnetic piece 104 changes to become close to the housing 105 as becoming away from the axial line L102, and becomes a movement path like a curved line C2 shown by a chain double-dashed line in FIG. 18. At this moment, the permanent magnetic piece 104 of the rotating portion 103 passes through the vicinity of the magnetism detecting switch 106, so that the magnetism detecting switch 106 is turned on by magnetism formed by the permanent magnetic piece 104 of the rotating portion 103. Accordingly, it is detected that the toner 200 in the toner cartridge 100 is exhausted {refer to Japanese Unexamined Utility Model Publication JP-U 1-32049 (1989), for example}.

FIG. 19 is a cross section view showing a toner cartridge 100A of a fourth related art. Since the toner cartridge 100A has roughly the same configuration as the toner cartridge 100 of the third related art shown in FIG. 18 mentioned before except a rotating portion 103A connected to the rotation axis 102, the same components will be denoted by the same reference numerals, and a detailed description will be omitted. The rotating portion 103A connected to the rotation axis 102 of the toner cartridge 100A includes a supporting member 107 and a rotating member 108. One end of the supporting member 107 is connected to the rotation axis 102. One end of the rotating member 108 is connected to the other end of the supporting member 107 so as to be capable of making an angular displacement around an axial line L107 that passes through the other end and extends in parallel to the axial line L102 of the rotation axis 102. To the other end of the rotating member 108, the permanent magnet piece 104 is disposed. The supporting member 107 and the rotating member 108 is not flexible.

When the rotation axis 102 rotates around the axial line L102, the supporting member 107 and the rotating member 108 of the rotating portion 103A rotate, and the permanent magnet piece 104 of the rotating member 108 rotates. In the rotating portion 103A, the rotating member 108 is connected to the supporting member 107 so as to be capable of making an angular displacement, so that the movement path of the permanent magnet piece 104 disposed to the rotating member 108 becomes like a curved line C3 shown by a chain double-dashed line in FIG. 19 for the same reason as in the third related art mentioned before (refer to JP-U 1-32049, for example).

The copying machine of the first related art mentioned before detects the remaining amount of toner in the toner cartridge based on the permeability of the developer supplied from the developing portion to the photoreceptor drum and the surface density of the photoreceptor drum subjected to development by the developing portion, so that the copying machine detects that the remaining amount of toner in the toner cartridge is small, after at least the surface density of the photoreceptor drum decreases. Therefore, it is considerably difficult to prevent deterioration of an image formed on a recording sheet, in specific, decrease of the density of a formed image due to decrease of toner. Moreover, since the sensors of two kinds different from each other are used for detection of the remaining amount of toner, not only the manufacturing cost of the copying machine increases, but also the configuration and the control method of the copying machine become complicated.

Further, the rotating portion 103 of the toner cartridge 100 in the image forming apparatus of the second related art shown in FIG. 18 bends meeting with resistance from the toner 200 while rotating around the axial line L102 because the rotating portion 103 is flexible, but even if the amount of the toner is the same, depending on the condition of the toner, for example, in the case where the toner coheres partially, a resistance force with which the rotating portion 103 meets from the toner 200 changes, the bending state of the rotating portion 103 changes, and the movement path of the permanent magnet piece 104 changes. Therefore, the movement path of the permanent magnetic piece 104 in the toner 200 does not become fixed at all times, and there is a risk that although a sufficient amount of the toner 200 remains, the permanent magnet piece 104 is placed in the vicinity of the magnetism detecting switch 106 due to some factor and it is mistakenly detected that the toner is exhausted.

Further, although the rotating portion 103A of the toner cartridge 100A in the image forming apparatus of the third related art shown in FIG. 19 does not have flexibility, the rotating member 108 of the rotating portion 103A is capable of making an angular displacement around the axial line L107 parallel to the axial line L102 of the rotation axis 102, so that there is the same problem as in the aforementioned second related art.

FIG. 20 is a cross section view showing a state where the remaining amount of the toner 200 in the toner cartridge 100A of the third related art mentioned before is small. In the case where there is toner more outward in the radius direction than a movement path C4 of the other end of the supporting member 107 of the rotating member 103A shown by a chain two-dashed line when the rotating member 103A is rotating, when the rotation axis 102 rotates in a rotation direction C (clockwise in FIG. 20) around the axial line L102, the permanent magnet piece 104 moves sliding on an upper surface 200*a* of a toner layer. The radius of the movement path C3 of the permanent magnet piece 104 shown in FIG. 20 is shown in FIG. 19. The radius is smaller than the radius of the movement path C3 of the permanent magnet piece 104 in the case where the remaining amount of the toner 200 is larger than in the state shown in FIG. 20. Therefore, the distance from the permanent magnet piece 104 to the magnetism detecting switch 106 does not change in a manner that the distance becomes small as the remaining amount of the toner decreases, so that there is a possibility that the magnetism detecting switch 106 mistakenly detects the remaining amount of the toner 200.

Further, although such a method can be considered as to detect the dot number of an image to be formed on a recording sheet and detect the remaining amount of toner in the toner cartridge based on the detected dot number, the relation between the dot number and the consumption amount of the toner is easily affected by the surrounding environment, so that it is difficult to accurately detect the remaining amount of the toner.

Further, such a method can be considered as to dispose a light-transmitting transmission window, use an optical detecting sensor and detect the remaining amount of toner. However, in this toner cartridge, it is necessary to keep the transmission window in the state where the transmission window can transmit light at all times, with the result that means for cleaning the transmission window is necessary, and the structure of the toner cartridge becomes complicated. Moreover, the optical detecting sensor is easily affected by the light-transmitting state of the transmission window, and the detection accuracy is low.

Further, such a method can also be considered as to dispose a vibration detecting sensor to the toner cartridge, vibrate the housing and detect the remaining amount of toner based on the vibration state of the housing. However, in this toner cartridge, it is necessary to replace the vibration detecting sensor together with the toner cartridge, so that the manufacturing cost of the toner cartridge becomes extremely high.

DISCLOSURE OF INVENTION

Hence, an object of the invention is to provide a remaining amount of toner detecting apparatus capable of highly accurately detecting the remaining amount of toner with a simple configuration, a toner cartridge in which the remaining amount of toner is highly accurately detected with a simple configuration, and an image forming apparatus which enables an operator to easily recognize time to resupply toner and is capable of forming an image of high image quality.

The invention is a remaining amount of toner detecting apparatus which detects a remaining amount of toner stored in a housing for storage of toner, the remaining amount of toner detecting apparatus comprising:

a detection auxiliary member disposed in the housing;

a holding member which is flexible and has one end connected to an outer periphery of a stirring member which is rotated to stir the toner in the housing, and another end at which the detection auxiliary member is held;

detecting means disposed near the lower portion of the housing, for detecting a distance from the detecting means to the detection auxiliary member when the detection auxiliary member is moved by rotation of the stirring member and passes through a detection position; and calculating means for calculating the remaining amount of the toner based on the distance from the detecting means to the detection auxiliary member.

According to the invention, the remaining amount of toner detecting apparatus comprises a holding member and a detection auxiliary member. The holding member is flexible, and one end thereof is connected to the outer periphery of the stirring member that rotates and stirs the toner stored in the housing. The detection auxiliary member is held by the other end of the holding member and disposed in the housing. Consequently, the holding member and the detection auxiliary member can rotate with rotation of the stirring member. When at least the outer periphery of the stirring member rotationally moves in a toner layer stored in the housing, the outer periphery of the stirring member rotates by pushing the toner layer aside, and forms a movement path in the toner layer. Since the holding member connected to the outer periphery of the stirring member is flexible, when the stirring member rotates in the toner layer stored in the housing, the holding member can rotationally move smoothly while bending along the movement path formed in the toner layer by the outer periphery of the stirring member and keeping the same rotation radius as the rotation radius of the outer periphery. Therefore, at this moment, the detection auxiliary member held by the holding member can rotationally move smoothly along the movement path formed in the toner layer by the outer periphery of the stirring member while keeping the same rotation radius as the rotation radius of the outer periphery. Moreover, when the amount of the toner stored in the housing decreases and the stirring member cannot rotate in the toner layer, the movement path is not formed in the toner. At this moment, since the holding member connected to the outer periphery of the stirring member is flexible, the detection auxiliary member increases the rotation radius due to the empty weight, and rotationally moves with a rotation radius larger than that of the outer periphery of the stirring member in a manner that the detection auxiliary member rotationally moves on the upper surface of the toner layer while being in contact therewith.

The detecting means is disposed near the lower portion of the housing, and detects the distance to the detection auxiliary member therefrom when the detection auxiliary member is rotationally moved by rotation of the stirring member and passes through the detection position. Since the detection auxiliary member rotationally moves while keeping a fixed rotation radius as mentioned before when at least the outer periphery of the stirring member rotates in the toner layer stored in the housing, the distance to the detection auxiliary member detected by the detecting means is fixed. Moreover, when the amount of the toner stored in the housing decreases and the stirring member cannot rotate in the toner layer, the detection auxiliary member rotationally moves with a larger rotation radius than that of the outer periphery of the stirring member as mentioned before, so that the distance to the detection auxiliary member detected by the detecting means becomes small as the amount of the toner decreases and the upper surface of the toner layer goes downward.

The calculating means calculates the remaining amount of the toner based on the distance from the detecting means to the detection auxiliary member. For example, when the detected distance to the detection auxiliary member is constant, the calculating means determines that the amount of the toner stored in the housing is more than a specified amount. Moreover, for example, when the distance to the detection auxiliary member detected being fixed becomes small, the calculating means determines that the amount of the toner stored in the housing is equal to or less than the specified amount, and calculates the remaining amount. In this way, the calculating means can detect the remaining amount of the toner stored in the housing. Therefore, it is possible to highly accurately detect the remaining amount of the toner with such a simple configuration.

Further, the invention is characterized in that: the detection auxiliary member passes through a predetermined detection position, and thereby a magnetic field in the detection position is changed; and the detecting means detects the distance to the detection auxiliary member based on the change of the magnetic field in the detection position by the detection auxiliary member.

According to the invention, the detection auxiliary member passes through the predetermined detection position, and thereby changes the magnetic field in the detection position. The detecting means detects the distance to the detection auxiliary member based on the change of the magnetic field in the detection position by the detection auxiliary member. Consequently, when the detecting means detects the distance to the detection auxiliary member, the existence of the detection auxiliary member does not hinder rotation of the stirring member or change of the position of the detection auxiliary member based on the remaining amount of the toner. Therefore, it is possible to realize highly accurate detection of the remaining amount of the toner.

Furthermore, the invention is characterized in that the detection auxiliarymember is made of a material having electrical conductivity.

According to the invention, the detection auxiliary member is made of a material having electrical conductivity, so that when the detection auxiliary member passes through the detection position, an eddy current is generated by the magnetic field in the detection position. Due to this eddy current, a magnetic field is generated around the detection auxiliary member. Therefore, the detection auxiliary member can change the magnetic field in the detection position by passing through the detection position. Consequently, the detecting means can detect the distance to the detection auxiliary member passing through the detection position.

Still further, the invention is characterized in that the detection auxiliary member is made of a material having magnetism.

According to the invention, the detection auxiliary member is made of a material having magnetism, so that the detection auxiliary member can change the magnetic field in the detecting position when passing through the detection position. Consequently, the detecting means can detect the distance to the detection auxiliary member that passes through the detection position.

Still further, the invention is characterized in that the length between both ends of the holding member is equal to or less than one half of the circumference of a circle whose radius is the distance from the rotation center of the stirring member to the outer periphery.

According to the invention, the length between both the ends of the holding member is equal to or less than one half of the circumference of a circle whose radius is the distance from the rotation center of the stirring member to the outer periphery. For example, in the case where the holding member is placed more upward than the stirring member and more upward than the toner layer, the other end of the holding member hangs down due to the weight of the detection auxiliary member. By making the length between both the ends of the holding member one half or less of the circumference of a circle whose radius is the distance from the rotation center of the stirring member to the outer periphery, it is possible to prevent the other end of the holding member from being wound around the rotation center of the stirring member as far as possible while the stirring member is rotating. Moreover, setting the length between both the ends of the holding member in the aforementioned length range is preferable for that when the stirring member rotates in the toner layer, the holding member rotationally moves smoothly while bending along the movement path formed in the toner layer by the outer periphery of the stirring member and keeping the same rotation radius as the rotation radius of the outer periphery. Consequently, it is possible to prevent the detection auxiliary member from being undesirably displaced. Accordingly, it is possible to detect the remaining amount of the toner highly accurately and securely.

Still further, the invention is characterized in that the maximum detectable distance of detectable distances to the detection auxiliary member by the detecting means is smaller than the distance between the movement path of the outer periphery and the detecting means when the stirring member is rotated.

According to the invention, the maximum detectable distance of detectable distances to the detection auxiliary member by the detecting means is smaller than the distance between the movement path of the outer periphery and the detecting means when the stirring member is rotated. Consequently, for example, the amount of the toner stored in the housing decreases, the stirring member cannot rotate in the toner layer, and the detection auxiliary member rotationally moves outside the movement path of the outer periphery of the stirring member, so that the detecting means can detect the distance to the detection auxiliary member on this occasion. Moreover, when the toner is sufficiently stored in the housing, that is, when at least the outer periphery of the stirring member can rotationally move in the toner layer stored in the housing, the detection auxiliary member rotationally moves along the movement path formed in the toner layer by the outer periphery of the stirring member while keeping the same rotation radius as the rotation radius of the outer periphery, so that the detecting means does not detect the detection auxiliary member on this occasion. Therefore, it is possible to prevent the detecting means from unnecessarily performing a detecting operation when the toner is sufficiently stored in the housing, and detect the remaining amount of the toner with high accuracy.

Still further, the invention is characterized in that the detecting means is provided with a plurality of detecting portions whose maximums of detectable distances to the detection auxiliary member are different.

According to the invention, the detecting means is provided with the plurality of detecting portions whose maximum detectable distances of detectable distance to the detection auxiliary member are different. Since the maximum detectable distances from the detecting means to the detection auxiliarymember differ among the detecting portions, a plurality of distances to the detection auxiliary member that can be detected by the respective detecting portions exist. Therefore, it is possible to detect the distance from the detecting means to the detection auxiliary member plural times in a multistage manner, and also detect the remaining amount of the toner stored in the housing plural times in a multistage manner.

Still further, the invention is characterized in that the detecting means is provided with a plurality of detecting portions disposed in different positions with respect to the movement direction of the outer periphery of the stirring member.

According to the invention, the detecting means is provided with the plurality of detecting portions disposed in different positions with respect to the movement direction of the outer periphery of the stirring member. In the case where the plurality of detecting portions of the detecting means are disposed in different positions with respect to the movement direction of the outer periphery of the stirring member, for example, in positions spaced from each other toward the upstream side in the movement direction of the outer periphery, the respective detecting portions are placed in different positions in the vertical direction. Therefore, as the upper surface of the toner layer in the housing goes downward, the distances from the detecting portions to the detection auxiliary member are detected in the order of detecting portions placed upward. Consequently, it is possible to detect the distance from the detecting means to the detection auxiliary member plural times in a multistage manner, and also detect the remaining amount of the toner stored in the housing plural times in a multistage manner.

Still further, the invention is characterized by further comprising notifying means for giving notice of information on the calculated remaining amount of the toner.

According to the invention, notice is given of information on the calculated remaining amount of the toner by the notifying means, so that the operator can easily check the remaining amount of the toner. Therefore, the operator can estimate time to replenish with the toner and the replenishment amount based on the notified remaining amount of the toner, and replenish the housing with the toner before the toner is exhausted from the housing.

Still further, the invention is characterized in that when the remaining amount of the toner is a predetermined reference amount or less, the notifying means gives notice that the remaining amount of the toner is not more than the predetermined reference amount.

According to the invention, when the remaining amount of the toner is not more than the predetermined reference amount, notice is given by the notifying means that the remaining amount of the toner is not more than the predetermined reference amount. Consequently, the operator can confirm that the remaining amount of the toner is not more than the reference amount. Therefore, the operator can recognize based on the aforementioned notification that time to replenish the housing with the toner has come.

Still further, the invention is characterized in that the notifying means gives notice of the number of sheets of images which can be formed of the remaining amount of the toner.

According to the invention, notice is given of the number of sheets of images which can be formed of the remaining amount of the toner by the notifying means, so that the operator can recognize the time and quantity to replenish with the toner based on the number of sheets of formable images.

Still further, the invention is characterized in that the notifying means gives notice of information on the remaining amount of the toner in a multistage manner or in a row in response to the remaining amount of the toner.

According to the invention, notice is given of information on the remaining amount of the toner by the notifying means in a multistage manner or in a row in response to the remaining amount of the toner, so that the operator can check the remaining amount of the toner in detail.

Still further, the invention is characterized in that the detecting means is a permeability sensor.

According to the invention, the detecting means is realized by a permeability sensor, so that it is possible to detect the distance to the detection auxiliary member.

Still further, the invention is a toner cartridge installed in an image forming apparatus so as to be attached thereto and detached therefrom, the toner cartridge comprising:

a housing for storage of toner;

a stirring member disposed in the housing so as to rotate and stir thereby the toner in the housing;

a detection auxiliary member disposed in the housing; and a holding member which is flexible and has one end connected to the outer periphery of the stirring member, and another end at which the detection auxiliary member is held.

According to the invention, the toner cartridge is installed in an image forming apparatus so as to be attached thereto and detached therefrom. Moreover, in the toner cartridge, the stirring member is disposed in the housing so as to be capable of rotating, and stirs the toner in the housing by rotating, thereby preventing the toner from cohering. Furthermore, the toner cartridge further comprises the detection auxiliary member and the holding member of the aforementioned remaining amount of toner detecting apparatus, so that, for example, by using the detecting means of the aforementioned remaining amount of toner detecting apparatus, it is possible to detect the distance to the detection auxiliary member. Besides, by using the calculating means of the aforementioned remaining amount of toner detecting apparatus, it is possible to calculate the remaining amount of the toner based on the detected distance. Therefore, in response to the remaining amount of the toner in the housing calculated in this way, the operator can remove a toner cartridge with a small remaining amount of toner from an image forming apparatus, and install a new toner cartridge sufficiently storing toner into the housing, thereby replacing the toner cartridge.

Still further, the invention is characterized in that the lower portion of the housing is formed into a curved shape which is convex down with respect to the movement direction of the outer periphery of the stirring member.

According to the invention, the lower portion of the housing is formed into a curved shape which is convex down with respect to the movement direction of the outer periphery of the stirring member, so that the detection auxiliary member can rotationally move facing the lower portion of the housing when rotationally moving in the lower portion of the housing.

Still further, the invention is an image forming apparatus comprising:

a housing in which toner is stored;

a stirring member which is disposed in the housing so as to be capable of rotating and stirs the toner in the housing by rotating; and a remaining amount of toner detecting apparatus comprising:

a detection auxiliary member disposed in the housing;

a holding member which is flexible, one end of which is connected to the outer periphery of the stirring member, and the other end of which holds the detection auxiliary member;

detecting means disposed near the lower portion of the housing, for detecting the distance to the detection auxiliary member when the detection auxiliary member is moved by rotation of the stirring member and passes through a detection position; and calculating means for calculating the remaining amount of the toner based on the distance from the detecting means to the detection auxiliary member.

According to the invention, the image forming apparatus comprises the housing in which the toner is stored, and the stirring member disposed in the housing so as to be capable of rotating. Since the stirring member stirs the toner in the housing by rotating, it is possible to prevent the toner from cohering in the housing. Moreover, since the image forming apparatus comprises the aforementioned remaining amount of toner detecting apparatus, it is possible to detect the remaining amount of the toner in the housing.

Still further, the invention is an image forming apparatus comprising:

an image forming apparatus main unit; and a toner cartridge installed in the image forming apparatus main unit so as to be attached thereto and detached therefrom, the toner cartridge comprising:

a housing in which toner is stored;

a stirring member which is disposed in the housing so as to rotate and stir the toner in the housing;

a detection auxiliary member disposed in the housing; and a holding member which is flexible and has one end connected to the outer periphery of the stirring member, and another end at which the detection auxiliary member is held, wherein the image forming apparatus main unit includes:

detecting means disposed near the lower portion of the housing, for detecting the distance to the detection auxiliary member when the detection auxiliary member is moved by rotation of the stirring member and passes through a detection position; and calculating means for calculating the remaining amount of the toner based on the distance from the detecting means to the detection auxiliary member.

According to the invention, into the image forming apparatus, the aforementioned toner cartridge is installed so as to be attached thereto and detected therefrom. Moreover, the image forming apparatus is equipped with the detecting means and the calculating means of the aforementioned remaining amount of toner detecting apparatus. Consequently, the image forming apparatus can detect the remaining amount of the toner stored in the toner cartridge.

BRIEF DESCRIPTION OF THE DRAWINGS

Other and further objects, features, and advantages of the invention will be more explicit from the following detailed description taken with reference to the drawings wherein.

BEST MODE FOR CARRYING OUT THE INVENTION

Figure 1:
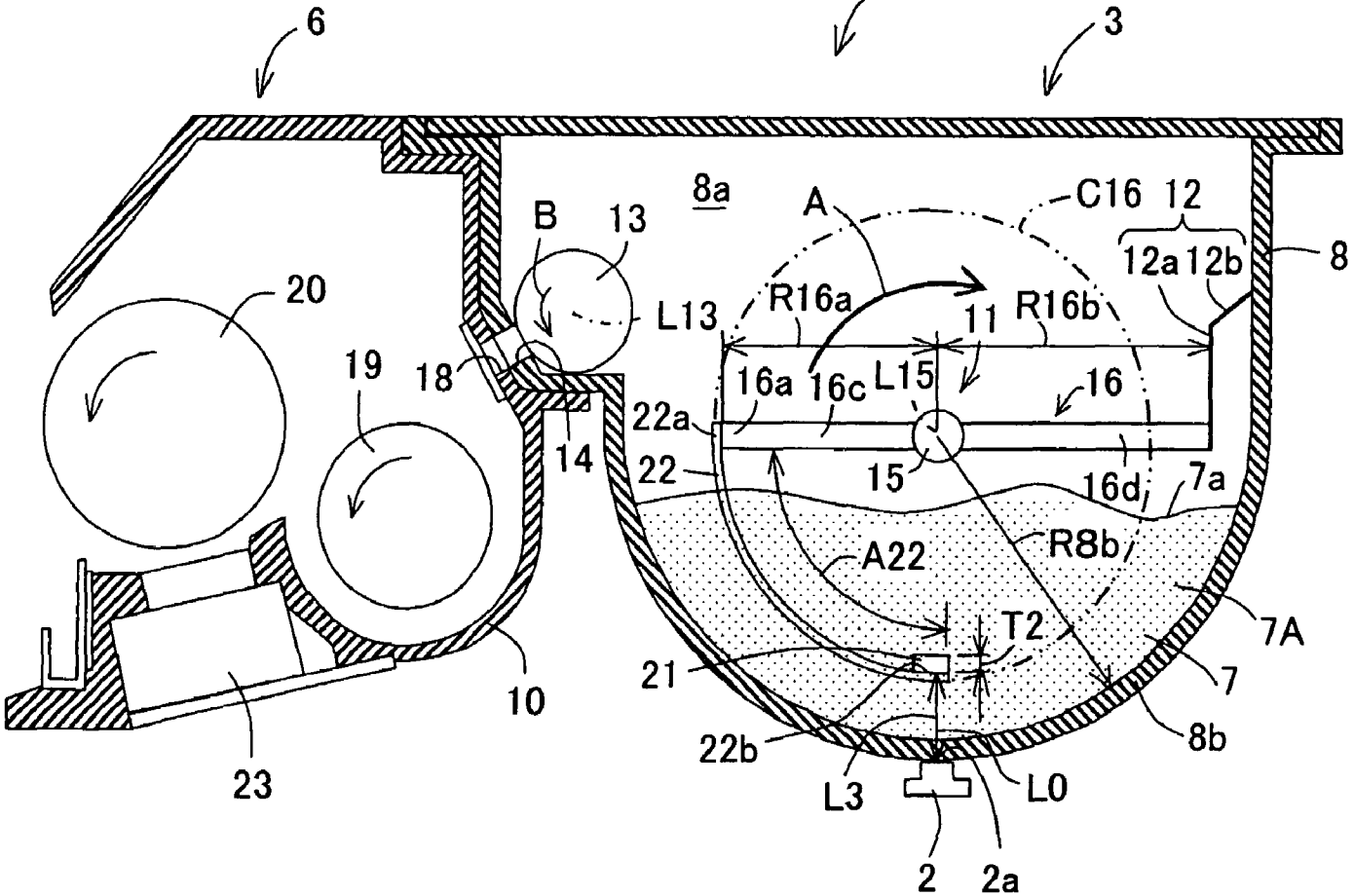
FIG. 1 is a cross section view showing a developing apparatus 1 according to a first embodiment of the invention.

Now referring to the drawings, preferred embodiments of the invention are described below.

Figure 2:
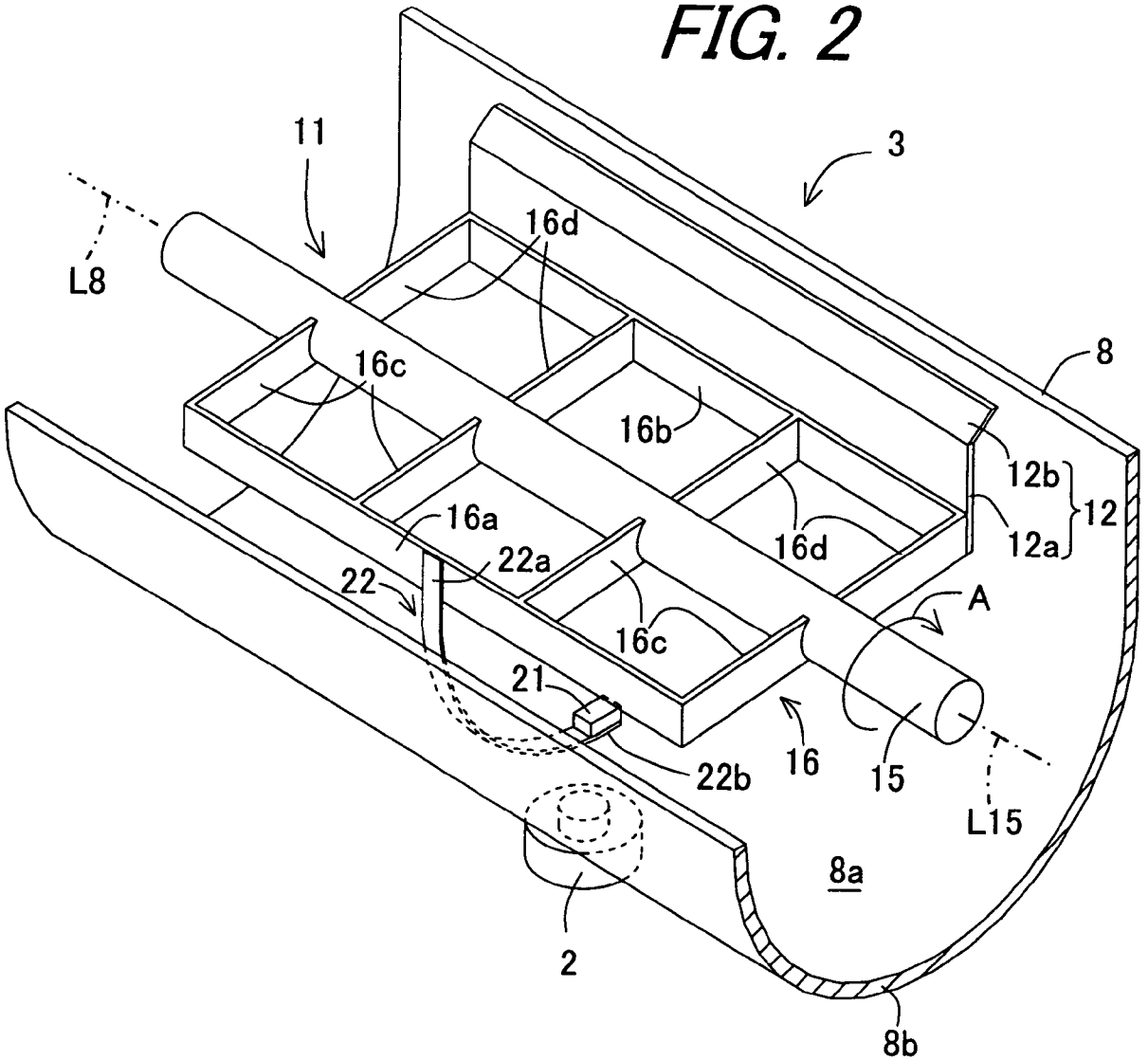
FIG. 2 is a magnified perspective view showing a detecting component 2 and a toner cartridge 3 of the developing apparatus 1.
Figure 3:
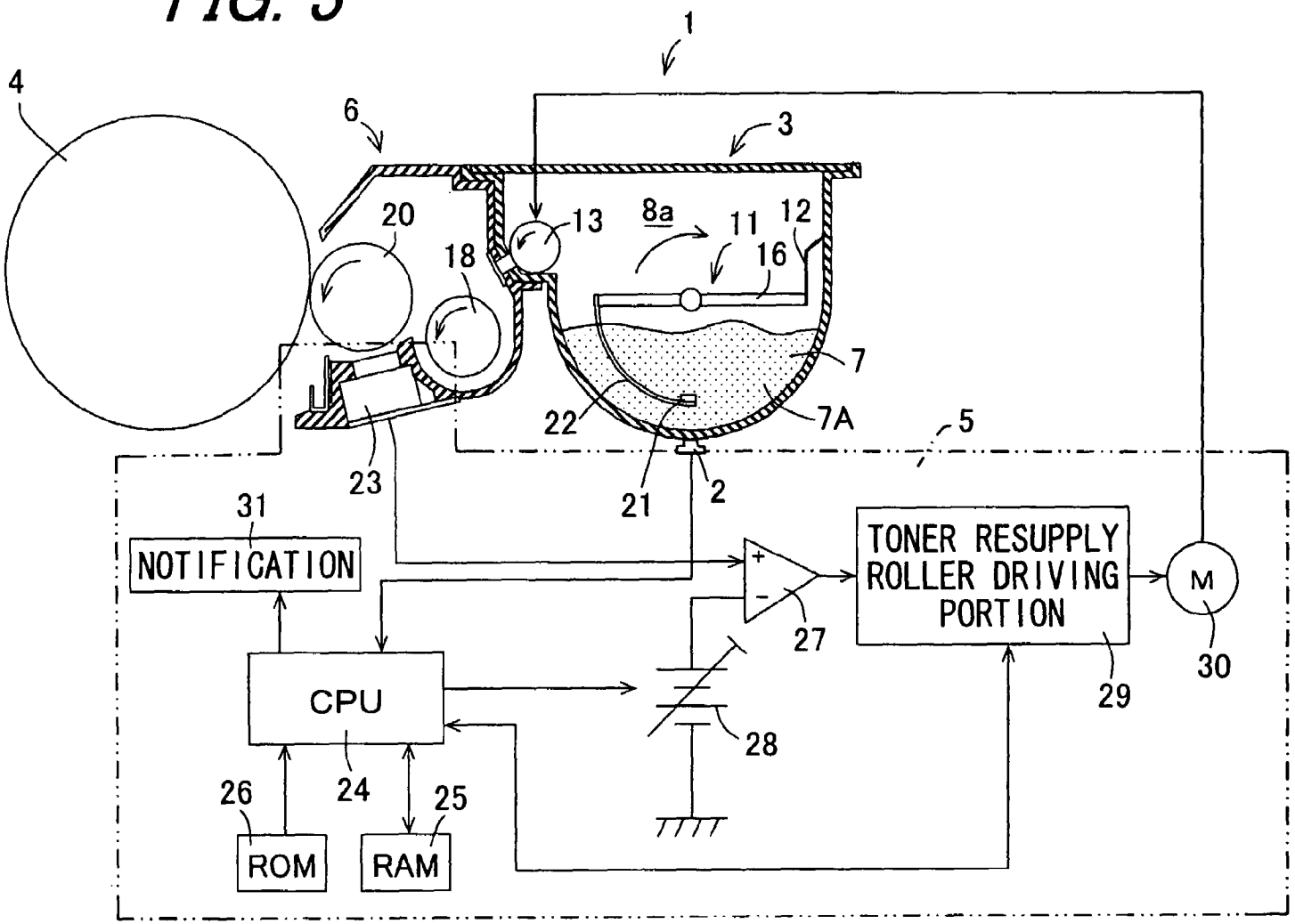
FIG. 3 is a block diagram showing the configuration of the developing apparatus 1.

FIG. 1 is a cross section view showing a developing apparatus 1 according to a first embodiment of the invention. FIG. 2 is a magnified perspective view showing a detecting component 2 and a toner cartridge 3 of the developing apparatus 1. FIG. 3 is a block diagram showing the configuration of the developing apparatus 1. The developing apparatus 1 includes the detecting component 2, the toner cartridge 3, a controlling portion 5 and a developing portion 6. The developing apparatus 1 supplies toner 7 stored in the toner cartridge 3 to a photoreceptor drum 4, develops an electrostatic latent image formed on the photoreceptor drum 4, and makes the image visible.

Figure 10:
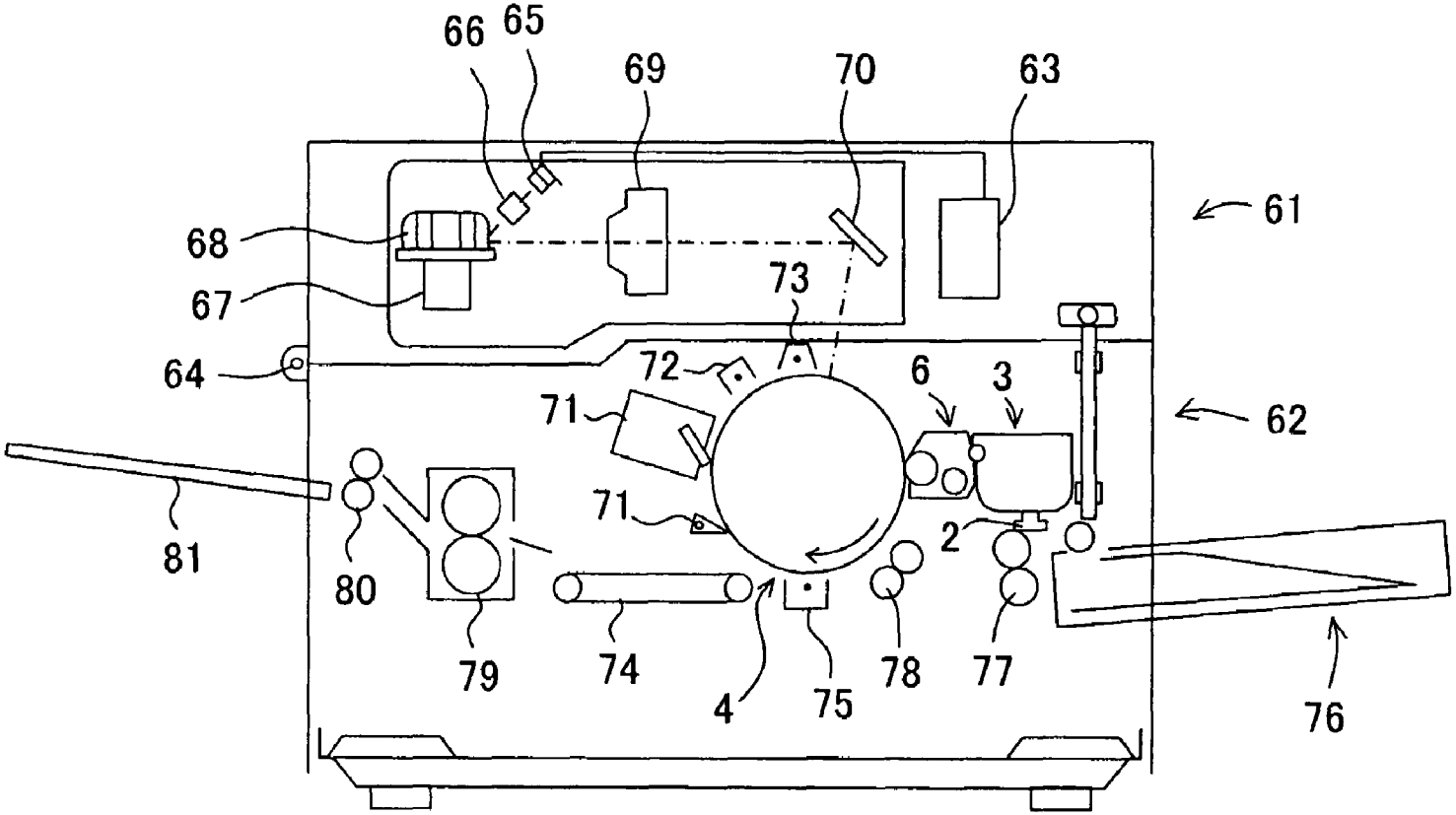
FIG. 10 is a simplified cross section view showing the configuration of the image forming apparatus 60 equipped with the developing apparatus 1 of the first embodiment.

The toner cartridge 3 is installed so as to be attached to and detached from the developing portion 6 of an image forming apparatus 60 (refer to FIG. 10). The toner cartridge 3 includes a housing 8, a stirring member 11, a detection auxiliary member 21, a holding member 22 and a toner resupply roller 13. The housing 8 has a storing space 8*a* that stores the toner 7 used for electrophotographic image formation, and the toner 7 is stored therein. In the storing space 8*a* of the toner cartridge 3, two layers, that is, a toner layer 7A chiefly formed by the toner 7 and a gas layer formed by gas above the toner layer 7A are formed.

Further, the inner peripheral surface of a lower portion 8*b* of the housing 8 is formed into a curved shape which is convex down. In detail, the lower portion 8*b* of the housing 8 is formed into one of semicylindrical shapes obtained by dividing a cylinder into two by a virtual plane parallel to an axial line thereof, and the cross section shape perpendicular to the axial line becomes a substantially U-letter shape. The axial line, that is, an axial line to become the center of curvature of the inner peripheral surface of the lower portion 8*b* of the housing 8 is referred to as a housing axial line L8.

The stirring member 11 is disposed in the housing 8, that is, in the storing space 8*a* of the housing 8 so as to be capable of rotating, and stirs the toner 7 in the housing 8 by rotating. In detail, the stirring member 11 is disposed so as to be capable of rotating around the housing axial line L8. In more detail, the stirring member 11 includes a stirring axis 15 and a stirring wing portion 16. The stirring axis 15 is formed into a columnar shape, placed so that a stirring axial line L15 as an axial line thereof is coaxial with the housing axial line L8, and disposed so as to be capable of rotating about the stirring axial line L15.

The stirring wing portion 16 is formed like a latticed door roughly. In detail, the stirring wing portion 16 includes a first outer periphery 16*a*, a second outer periphery 16*b*, a first connecting portion 16*c* and a second connecting portion 16*d*, and the first outer periphery 16*a*, the second outer periphery 16*b*, the first connecting portion 16*c* and the second connecting portion 16*d* are formed like flat plates. The first outer periphery 16*a* as the outer periphery of the stirring member 11 is placed more outward in the radius direction than the stirring axis 15, extending in the direction of the stirring axial line L15, so as to be parallel to a virtual plane passing through the stirring axial line L15 of the stirring axis 15 and so that the thickness direction of the first outer periphery 16*a* is parallel to the radius direction. The second outer periphery 16*b* is placed more outward in the radius direction than the stirring axis 15, extending in the direction of the stirring axial line L15, so as to be parallel to a virtual plane passing through the stirring axial line L15 of the stirring axis 15 and so that the thickness direction of the second outer periphery 16*b* is parallel to the radius direction. Moreover, the first outer periphery 16*a* and the second outer periphery 16*b* are placed in parallel. A distance R16*a* from the stirring axial line L15 to the first outer periphery 16*a* (may be referred to as "rotation radius of the first outer periphery 16*a*" hereinafter) and a distance R16*b* from the stirring axial line L15 to the second outer periphery 16*b* (may be referred to as "rotation radius of the second outer periphery 16*b*" hereinafter) are set so as to be smaller than a radius of curvature R8*b* from the housing axial line L8, that is, from the stirring axial line L15 to the lower portion 8*b* of the housing 8. In the toner cartridge 3 of the developing apparatus 1 of the present embodiment, the rotation radius R16*a* of the first outer periphery 16*a* may be 55 mm, for example, and the rotation radius R16*b* of the second outer periphery 16*b* may be 60 mm, for example. Moreover, the radius of curvature R8*b* from the housing axial line L8 to the lower portion 8*b* of the housing 8 is approximately 65 mm.

A plurality of, in the present embodiment, four first connecting portions 16*c* are provided in the stirring wing portion 16, and connected to the stirring axis 15 and the first outer periphery 16*a*. In detail, the respective first connecting portions 16*c* are placed side by side at roughly equal intervals in the direction of the stirring axial line L15, and placed so that the thickness direction of the first connecting portion 16*c* is perpendicular to the stirring axial line L15. A plurality of, in the present embodiment, four second connecting portions 16*d* are provided in the stirring wing portion 16, and connected to the stirring axis 15 and the second outer periphery 16*b*. In detail, the respective second connecting portions 16*d* are placed side by side at roughly equal intervals in the direction of the stirring axial line L15, and placed so that the thickness direction of the second connecting portion 16*d* is perpendicular to the stirring axial line L15.

The holding member 22 is made of, for example, a polymeric material such as polyethylene terephthalate (abbreviated to PET), and formed like a substantially rectangular film whose side having flexibility is the longitudinal direction. One end 22*a* in the longitudinal direction of the holding member 22 is connected to the first outer periphery 16*a* of the stirring wing portion 16 of the stirring member 11, in the present embodiment, connected to the first outer periphery 16*a* at the middle portion in the direction of the stirring axial line L15. The thickness and width of the holding member 22 are set so that the holding member is flexible to the extent that the holding member can bend along a movement path C16 formed in the toner layer 7A by the first outer periphery 16*a* as described later, and the thickness may be set to, for example, 50 μm or more and 100 μm or less approximately, and the width may be, for example, 15 mm.

The detection auxiliary member 21 is held by the other end 22*b* in the longitudinal direction of the holding member 22, and disposed in the housing 8. The detection auxiliary member 21 is made of a material having at least one of magnetism and electrical conductivity. The detection auxiliary member 21, the shape of which is not limited, may be like a substantially rectangular plate or may be a substantially circular plate, for example. In the case of being like a substantially circular plate, the detection auxiliary member is formed so as to have a diameter of 10 mm, for example. The thickness of the detection auxiliary member 21 is determined by the weight of the detection auxiliary member 21, resistance from the toner at the time of movement in the toner layer, hardness to deform and so on, and may be 0.1 mm or more and 2 mm or less, for example.

To the second outer periphery 16*b* of the stirring member 11, a scraping-out member 12 is disposed. The scraping-out member 12 is made of, for example, a polymeric material such as PET, and formed so as to have flexibility and elasticity. The scraping-out member 12 is fixed to the outer peripheral surface portion of the second outer periphery 16*b* of the stirring member 11, for example, via an adhesive. In detail, the scraping-out member 12 has a base portion 12*a* and a free end 12*b* that are like flat plates to be integrally molded. The base portion 12*a* of the scraping-out member 12 is fixed, on the second outer periphery 16*b* of the stirring member 11, to the entire outer peripheral surface of the second outer periphery 16*b* so that the thickness direction of the base portion 12*a* and the thickness direction of the second outer periphery 16*b* become parallel and the base portion protrudes toward the upstream in a rotation direction A of the stirring member 11 (clockwise direction in FIG. 1). The free end 12*b* of the scraping-out member 12 as a portion on the upstream side in the rotation direction A of the stirring member 11 is formed so as to incline outward in the radius direction from the base portion a toward the upstream side of the rotation direction A. Therefore, the scraping-out member 12 is formed so that the cross section shape perpendicular to the stirring axial line L15 has a substantially V-letter shape. The free end 12*b* of the scraping-out member 12 can elastically abut against the inner peripheral surface of at least the lower portion b of the housing 8. Since the stirring member 11 is configured as described above, the lower portion 8*b* of the housing 8 is formed into a curved shape which is convex down with respect to the movement direction of the first outer periphery 16*a* of the stirring member 11.

The stirring member 11 rotates in the rotation direction A around the stirring axial line L15 by a driving force from a not-shown driving source. At this moment, the first outer periphery 16*a* of the stirring wing portion 16 of the stirring member 11, the holding member 22 and the detection auxiliary member 21 also rotate in the rotation direction A around the stirring axial line L15. Moreover, the second outer periphery 16*b* of the stirring wing portion 16 of the stirring member 11 and the scraping-out member 12 also rotate in the rotation direction A around the stirring axial line L15, and the free end 12*b* of the scraping-out member 12 slidingly contacts the inner peripheral surface of at least the lower portion 8*b* of the housing 8 while elastically abutting thereagainst.

In the case where the toner 7 is stored in the storing space 8*a* of the housing 8 to the extent that an upper surface 7*a* of the toner layer 7A is placed in the vicinity of the stirring axial line L15 as shown in FIG. 1, when the stirring member 11 rotates in the rotation direction A around the stirring axial line L15, at least the stirring wing portion 16 of the stirring member 11 repeatedly lies buried in the toner layer 7A and leaves from the toner layer 7A. When the stirring wing portion 16 lies buried in the toner layer 7A and rotates around the stirring axial line L15, the toner layer 7A is thereby stirred, and the toner 7 is prevented from cohering in the housing 8. Moreover, at this moment, the toner 7 in the vicinity of the inner peripheral surface of the housing 8 makes an angular displacement in the rotation direction A around the stirring axial line L15 in the toner layer 7A while being held by the free end 12*b* of the scraping-out member 12 rotating in the rotation direction A around the stirring axial line L15 and the inner peripheral surface of the housing 8, and is scraped out upward from the toner layer 7A and supplied to the toner supply roller 13 disposed in the housing 8.

As to the first outer periphery 16*a* of the stirring wing portion 16 of the stirring member 11, when the stirring member 11 rotates in the rotation direction A around the stirring axial line L15, the thickness direction of the first outer periphery 16*a* becomes parallel to the radius direction. Consequently, in the case where the toner 7 is stored in the storing space 8*a* of the housing 8 to the extent that the upper surface 7*a* of the toner layer 7A is placed in the vicinity of the stirring axial line L15 as shown in FIG. 1, when the first outer periphery 16*a* of the stirring wing portion 16 of the stirring member 11 moves around the stirring axial line L15 in the toner layer 7A, the first outer periphery pushes the toner layer 7A aside at all times and rotates so as to separate to the inside in the radius direction and the outside in the radius direction of the first outer periphery 16*a*, and the movement path C16 whose central axial line is the stirring axial line L15 and that has a partially thin cylindrical shape is formed on the upstream side in the rotation direction A of the first outer periphery 16*a*. Since the holding member 22 connected to the first outer periphery 16*a* of the stirring member 11 is flexible, the holding member 22 can rotationally move smoothly while bending along the movement path C16 formed in the toner layer 7A and keeping the same rotation radius as the rotation radius R16*a* of the first outer periphery 16*a* in the aforementioned manner. Therefore, at this moment, the detection auxiliary member 21 held by the holding member 22 can rotationally move smoothly along the movement path C16 formed in the toner layer 7A by the first outer periphery 16*a* of the stirring member 11 while keeping the same rotation radius as the rotation radius R16*a* of the first outer periphery 16*a*.

Figure 20:
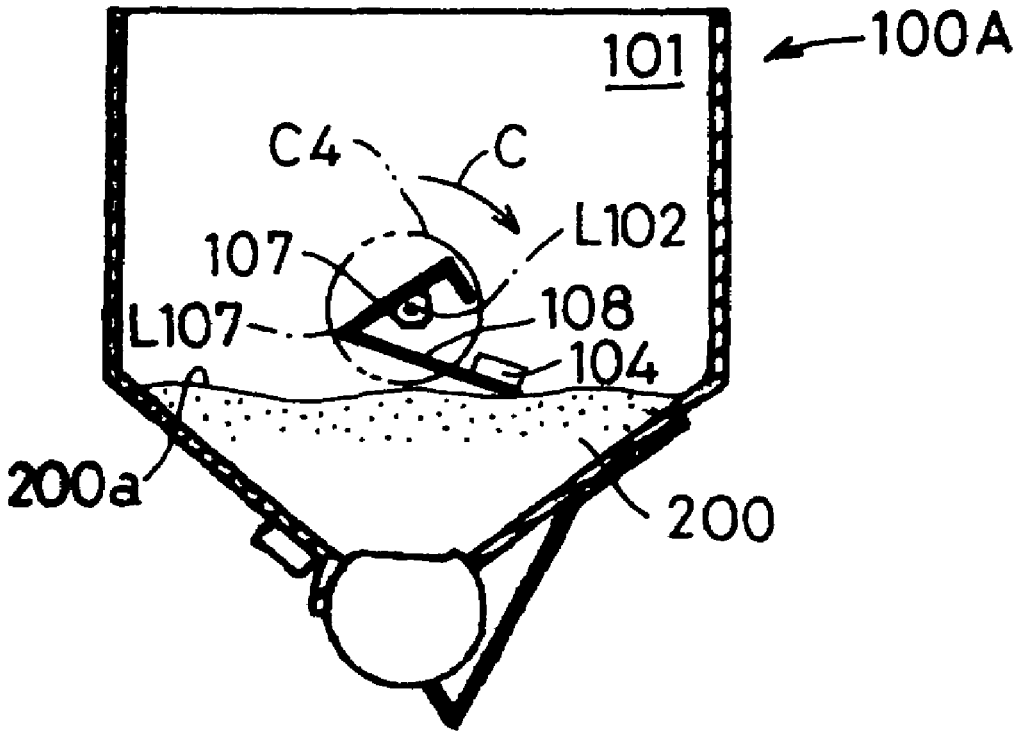
FIG. 20 is a cross section view showing a state where the remaining amount of the toner 200 in the toner cartridge 100A of the fourth related art mentioned before is small.

Accordingly, in the case where a sufficient amount of the toner 7 is stored in the housing 8, in concrete, in the case where at least the distance between the upper surface 7*a* of the toner layer 7A and the stirring axial line L15 is smaller than the rotation radius R16*a* of the first outer periphery 16*a* of the stirring member 11 in the housing 8, the first outer periphery 16*a* can lie buried in the toner layer 7A when rotating around the stirring axial line L15, so that it is possible to form the movement path C16 in the toner layer 7A. Consequently, unlike the movement path of the permanent magnet piece 104 of the fourth related art described in the related art shown in FIG. 20, the detection auxiliary member 21 can move along the movement path C16 at all times.

Figure 4:
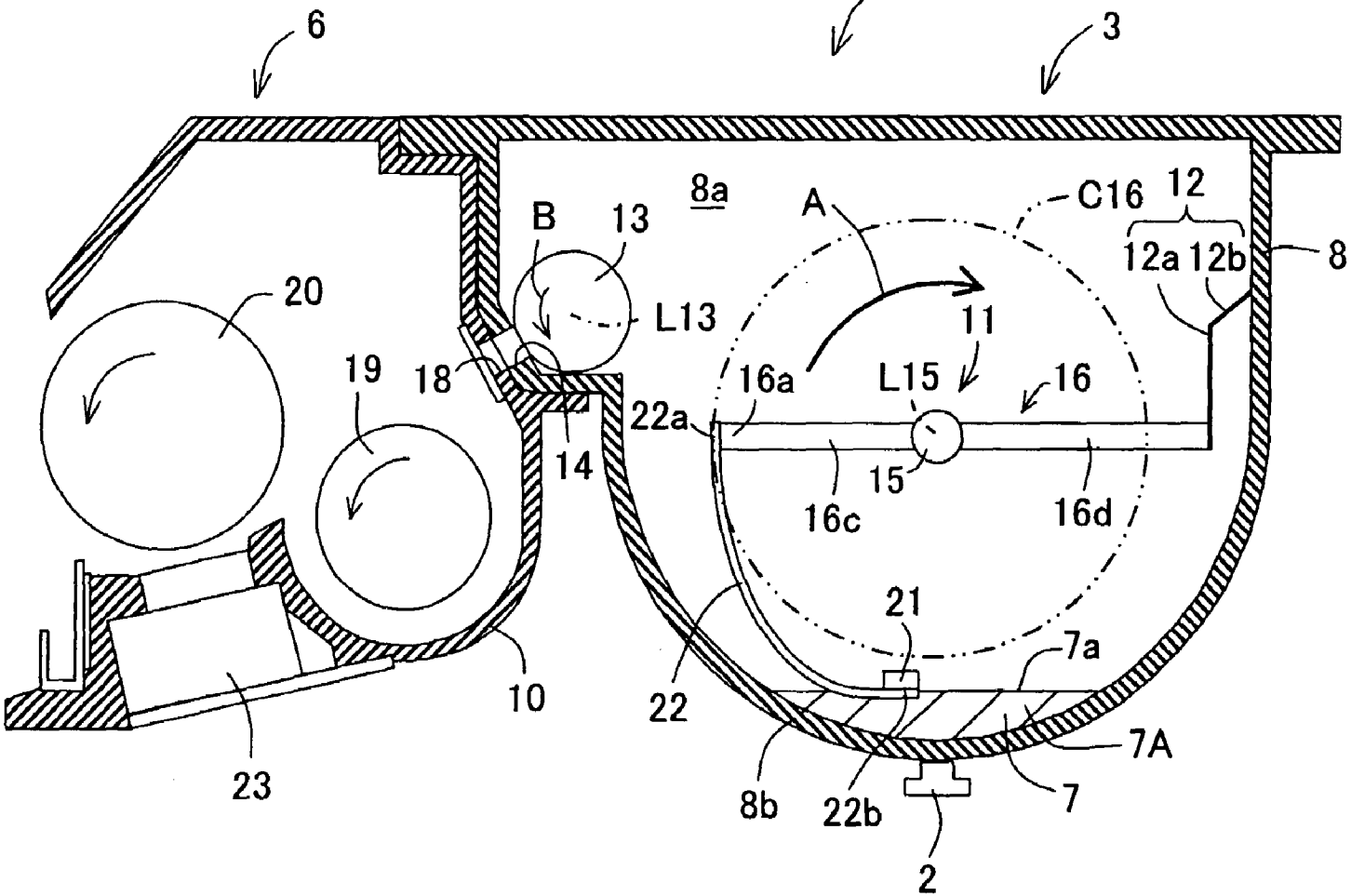
FIG. 4 is a cross section view showing the developing apparatus 1 in the case where the toner 7 in the housing 8 is a little.

FIG. 4 is a cross section view showing the developing apparatus 1 in the case where the toner 7 in the housing 8 is a little. In concrete, the case where the toner 7 in the housing 8 is a little is the case where the distance between the upper surface 7*a* of the toner layer 7A and the stirring axial line L15 is larger than the rotation radius R16*a* of the first outer periphery 16*a* of the stirring member 11. In this case, the first outer periphery 16*a* of the stirring member 11 cannot rotate around the stirring axial line L15 in the toner layer 7A, and cannot form the movement path C16 in the toner layer 7A. At this moment, since the holding member 22 connected to the first outer periphery 16*a* of the stirring member 11 is flexible, the rotation radius of the detection auxiliary member 21 becomes larger than that of the movement path C16 of the first outer periphery 16*a* due to the empty weight, and the detection auxiliary member rotationally moves on the upper surface 7*a* of the toner layer 7A while being in contact therewith.

Here, referring to FIG. 1 again, as to the holding member 22, a length A22 between both the ends, that is, length A22 between the one end 22*a* in the longitudinal direction and the other end 22*b* in the longitudinal direction is set to one half or less of the circumference of a circle whose radius is the distance R16*a* from the stirring axial line L15 as the rotation center of the stirring member 11 to the first outer periphery 16*a* of the stirring wing portion 16. Moreover, when the length A22 of the holding member 22 is too short, it is impossible to obtain enough bending moment to bend the holding member 22 along the movement path C16, with the result that the holding member 22 and the detection auxiliary member 21 cannot rotationally move smoothly while bending along the movement path C16 formed in the toner layer 7A by the first outer periphery 16*a* and keeping the same rotation radius as the rotation radius R16*a* of the first outer periphery 16*a*. Moreover, when the length A22 of the holding member 22 is too short, bending moment by the empty weight of the detection auxiliary member 21 acting on the holding member 22 becomes small, and the displacement amount of the other end 22*b* in the longitudinal direction of the holding member 22 becomes small, with the result that the movement path of the detection auxiliary member 21 substantially coincides with the movement path C16 of the first outer periphery 16*a* of the stirring member 11 regardless of the amount of the toner 7 in the housing 8. Therefore, the lower limit value of the length A22 of the holding member 22 should be set in consideration of the above. In the present embodiment, the length A22 between both the ends of the holding member 22 may be 110 mm, for example.

The toner resupply roller 13 is placed in the storing space 8*a* of the housing 8 on the side of the developing portion 6, more upward than the stirring axial line L15 of the stirring member 11. Moreover, the toner resupply roller 13 is disposed so as to be capable of rotating in a rotation direction B (counterclockwise in FIG. 1) around a roller axial line L13 that extends in parallel to the stirring axial line L15 of the stirring member 11. On the housing 8 below the toner resupply roller 13, a toner resupply hole 14 that passes through like a slit is formed. Toner supplied to the toner resupply roller 13 by the scraping-out member 12 adheres to the toner resupply roller 13. When the toner resupply roller 13 rotates around the roller axial line L13 by a driving force from a toner resupply motor 30 shown in FIG. 3, the toner adhering to the surface portion of the toner resupply roller 13 is scraped off, and the scraped-off toner falls into a development tank 10 of the developing portion 6 via the toner resupply hole 14 and a toner supply hole 18 that is disposed to the developing portion 6 and connected to the toner resupply hole 14.

The developing portion 6 develops an electrostatic latent image formed on the photoreceptor drum 4 and forms a toner image. The developing portion 6 of the present embodiment uses the dry two-component magnetic brush developing method. The developing portion 6 includes the toner supply opening 18, the development tank 10, a stirring roller 19 and a developing roller 20. Toner from the toner resupply hole 14 is resupplied to the development tank 10 via the toner supply opening 18 formed in the development tank 10. The toner resupplied to the development tank 1 is mixed by the stirring roller 19 with a carrier having magnetism which is previously stored in the development tank 10, whereby a magnetized developer is formed. The developer is stirred by the stirring roller 19 and frictionally charged. Further, the developer is guided to the vicinity of the developing roller 20 by the stirring roller 19.

The developing roller 20 is made of a nonmagnetic metallic material, for example, austenitic stainless steel like SUS304 defined in the Japanese Industrial Standards (abbreviated to JIS), aluminum alloy, brass and the like, and formed into a substantially cylindrical shape. The developing roller 20 is has a permanent magnet therein. Since the developing roller 20 has the permanent magnet therein, the developer guided to the vicinity of the developing roller 20 adheres to the developing roller 20. The developing roller 20 is in close vicinity to the photoreceptor drum 4, and a toner image is formed by movement of the toner adhering to the developing roller 20 to an electrostatic latent image formed on the photoreceptor drum 4.

Referring to FIG. 3 again, the controlling portion 5 includes a toner density detecting portion 23, the detecting component 2, a central processing unit (abbreviated to CPU) 24, a random access memory (abbreviated to RAM) 25, a read only memory (abbreviated to ROM) 26, a comparator 27, a reference voltage generating portion 28, a toner resupply roller driving portion 29, the toner resupply motor 30 and a notifying portion 31.

The detecting component 2 serving as the detecting means is disposed so as to face the outer periphery of the lower portion 8*b* of the housing 8. The detecting component 2 has a detecting surface portion 2*a* formed on the surface portion on one side in the thickness direction thereof. The detecting surface portion 2*a* is formed into a circular shape having a diameter of 10 mm, for example. In detail, in a manner that a virtual line which is orthogonal to the stirring axial line L15, which intersects a path that the central portion of the detection auxiliary member 21 rotating with the first outer periphery 16*a* of the stirring member 11 moves and which extends in the vertical direction passes through the center of the detecting surface portion 2*a* of the detecting component 2, the detecting component 2 is disposed so that the detecting surface portion 2*a* abuts against the outer periphery of the lower portion 8*b* of the housing 8. That is to say, the detecting component 2 is disposed so that the detecting surface portion 2*a* abuts against the lowest portion of the outer surface of the lower portion 8*b* of the housing 8. The detecting component 2 detects a distance L0 from the detecting surface portion 2*a* to one surface portion 21*a* in the thickness direction of the detection auxiliary member 21 (may be simply referred to as "detection distance" hereinafter), when the detection auxiliary member 21 is moved by rotation of the stirring member 11 in the rotation direction A around the stirring axial line L15, and passes through a detection position.

In the present embodiment, the detecting component 2 detects the distance to the detection auxiliary member 21 based on a change of a magnetic field in the detection position by the detection auxiliary member 21. In concrete, the detecting component 2 is realized by a permeability sensor in the present embodiment. The permeability sensor detects a change of permeability based on a change of a magnetic field. The detecting component 2 is realized by a permeability sensor of a differential transformer type in the present embodiment.

Further, in the present embodiment, the detecting component 2 is configured so that the maximum detectable distance that can be detected is smaller than the distance between the movement path C16 of the first outer periphery 16*a* and the detecting component 2 when the stirring member 11 is rotated. In concrete, the detecting component is configured so that the maximum detectable distance is smaller than a shortest distance L3 between the movement path C16 of the first outer periphery 16*a* and the detecting surface portion 2*a* of the detecting component 2. As the maximum detectable distance, in the present embodiment, a value which is substantially equal to the shortest distance L3 and smaller than the shortest distance L3 is selected. The detecting component 2 gives information based on the detection distance L0 to the CPU 24.

When at least the first outer periphery 16*a* of the stirring member 11 rotates in the toner layer 7A stored in the housing 8, the detection auxiliary member 21 rotationally moves while keeping the rotation radius R16*a* of the first outer periphery 16, so that the detection distance L0 detected by the detecting component 2 is fixed. Moreover, when the amount of the toner 7 stored in the housing 8 decreases and the stirring member 11 cannot rotate in the toner layer 7*a*, the detection auxiliary member 21 rotationally moves with a rotation radius larger than that of the first outer periphery 16*a* of the stirring member 11, so that the detection distance L0 detected by the detecting component 2 becomes small as the amount of the toner 7 decreases and the upper surface 7*a* of the toner layer 7A goes downward.

The CPU 24 serving as the calculating means calculates the remaining amount of the toner based on the distance from the detecting surface portion 2*a* of the detecting component 2 to the one end 21*a* in the thickness direction of the detection auxiliary member 21. The CPU 24 gives information based on the calculated remaining amount of the toner to the notifying portion 31. Moreover, the CPU 24 reads out and executes a control program stored in the ROM 26, and controls the respective components. The CPU 24 executes the control program, and gives control commands to the respective components and controls so that the components of the controlling portion 5 achieve specified functions, respectively.

Figure 5:
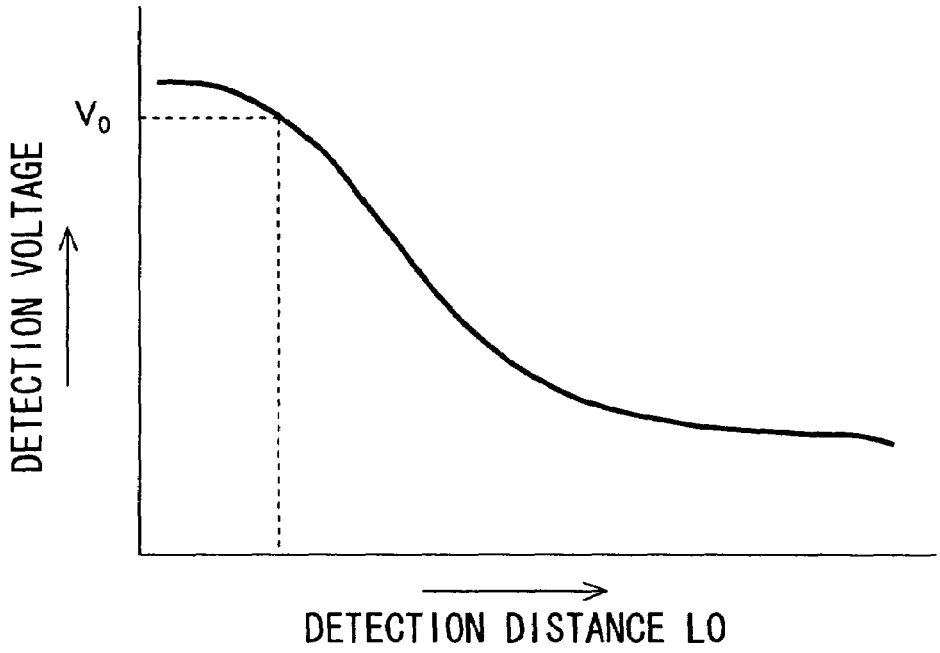
FIG. 5 is a graph showing the relation between the detection distance L0 detected in the case where the detection auxiliary member 21 is made of a material having magnetism and a detection voltage detected by the detecting component 2.

FIG. 5 is a graph showing the relation between the detection distance L0 detected in the case where the detection auxiliary member 21 is made of a material having magnetism and a detection voltage detected by the detecting component 2. The horizontal axis of the graph shows the detection distance L0, and the vertical axis of the graph shows the detection voltage. The detection auxiliary member 11 is made of a material having magnetism, for example, ferrite, iron and martensitic stainless steel having magnetism.

The detecting component 2 is realized by a permeability sensor in the present embodiment. The detecting component 2 previously generates a magnetic field in the detection position. Since the detection auxiliary member 21 has magnetism, the magnetic field in the detection position changes when the detection auxiliary member 21 passes through the detection position. The detecting component 2 detects the change of the magnetic field as the detection voltage. As shown in the graph of FIG. 5, the detection voltage decreases when the detection distance L0 increases. Consequently, it is possible to find the detection distance L0 based on the detection voltage. Accordingly, the detecting component 2 can detect the detection distance L0.

Figure 6:
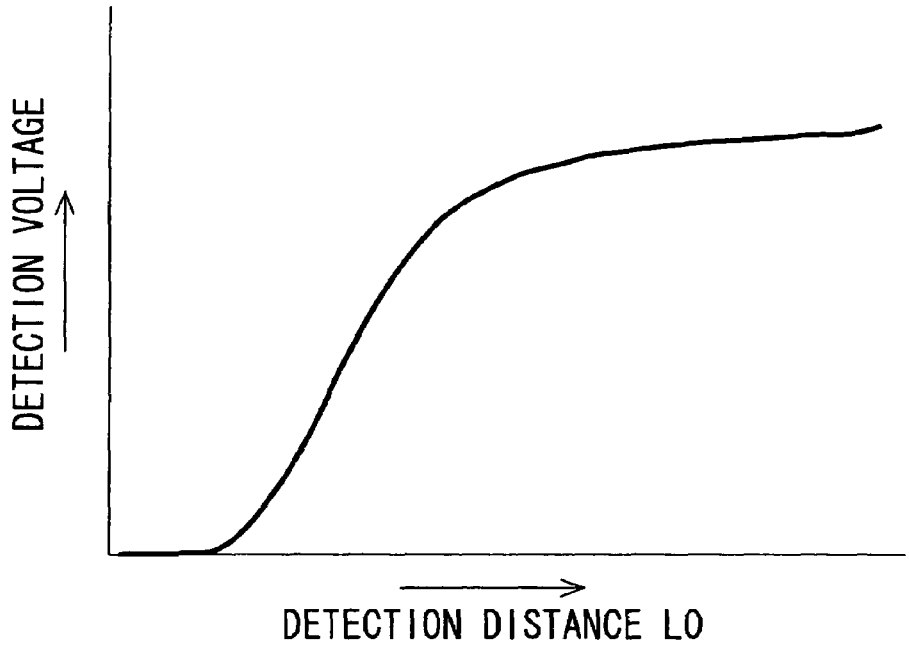
FIG. 6 is a graph showing the relation between the detection distance L0 detected in the case where the detection auxiliary member 21 is made of a material having electrical conductivity and the detection voltage of the detecting component 2.

FIG. 6 is a graph showing the relation between the detection distance L0 detected in the case where the detection auxiliary member 21 is made of a material having electrical conductivity and the detection voltage of the detecting component 2. The horizontal axis of the graph shows the detection distance L0, and the vertical axis of the graph shows the detection voltage. The detection auxiliary member 21 is made of a material having electrical conductivity, for example, made of aluminum and austenitic stainless steel.

The detecting component 2 previously generates a magnetic field. In the case where the detection auxiliary member 21 has electrical conductivity, magnetic flux piercing the detection auxiliary member 21 changes when the detection auxiliary member 21 passes through the detection position. At the detection auxiliary member 21, an eddy current is generated by the change of the magnetic flux. By this eddy current, a magnetic field is generated in a region around the detection auxiliary member 21. The detecting component 2 detects a change of the magnetic field due to the eddy current generated in the detection auxiliary member 21. Therefore, as shown in the graph of FIG. 6, the detection voltage increases when the detection distance L0 increases. Consequently, it is possible to find the detection distance L0 based on the detection voltage. Accordingly, the detecting component 2 can detect the detection distance L0.

Here, referring to FIG. 3 again, the toner density detecting portion 23 detects the toner density, which is the proportion of the toner in the developer adhering to the developing roller 20. As image formation is performed, the toner 7 in the development tank 10 decreases, and the toner density in the development tank 10 decreases. The toner density detecting portion 23 applies a voltage based on the detected toner density (may be simply referred to as "toner density voltage" hereinafter) to the comparator 27.

The reference power source generating portion 1 generates a predetermined reference voltage. The reference voltage is set to a voltage presenting such toner density that can form a toner image uniformly without irregularities. The reference voltage generating portion 28 applies the reference voltage to the comparator 27. The comparator 27 compares the given toner density voltage with the reference voltage. In the case where the toner density voltage is smaller than the reference voltage, that is, in the case where the toner density is lower than the density of a point of reference, the comparator 27 gives a driving command to the toner resupply roller driving portion 29.

The toner resupply roller driving portion 29 applies a voltage for driving to the toner resupply motor 30 while the driving command is given thereto. The toner resupply motor 30 is a motor for rotationally driving the toner resupply roller 13. To the toner resupply motor 30, a voltage is applied from the toner resupply roller driving portion 29, and the toner resupply motor rotationally drives the toner resupply roller 13. Consequently, the toner 7 in the toner cartridge 3 is supplied to the developing portion 6.

The RAM 25 temporarily stores information showing the toner density detected by the toner density detecting portion 23, and so on. The ROM 26 stores the control program and so on. The ROM 26 executes the stored program in accordance with the control command given from the CPU 24.

The notifying portion 31 serves as the notifying means, and gives notice of information on the remaining amount of the toner. For example, when the remaining amount of the toner is equal to or less than a predetermined reference amount, the notifying portion 31 gives notice that the remaining amount of the toner is equal to or less than the predetermined reference amount. Moreover, the notifying portion 31 gives notice of information on the remaining amount of the toner in response to the remaining amount of the toner in a multistage manner or in a row. The notifying portion 31 is realized by, for example, displaying means which displays letters and the like and sound generating means which generates sound.

Figure 7:
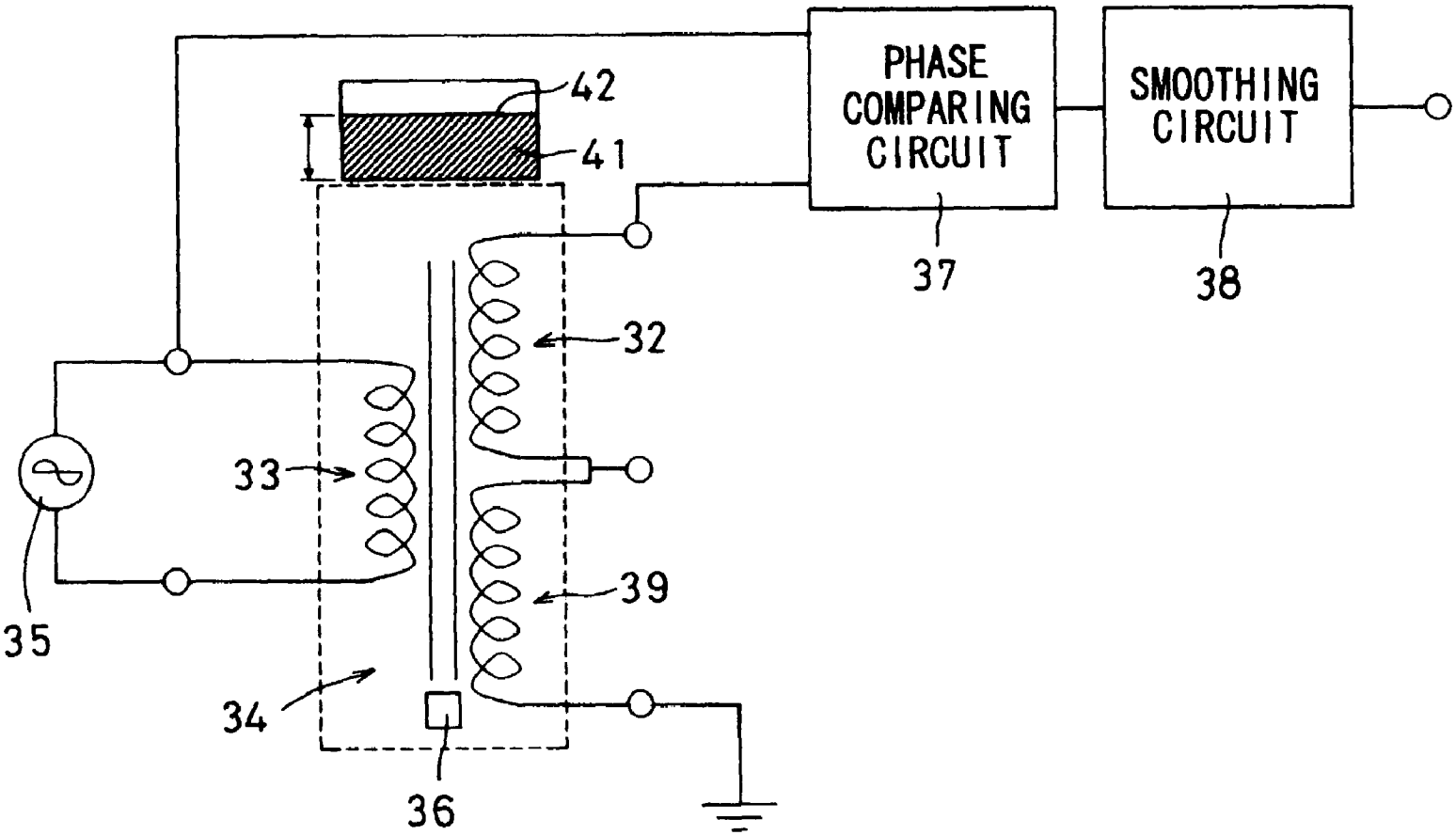
FIG. 7 is an electric circuit diagram showing the configuration of the detecting component 2.

FIG. 7 is an electric circuit diagram showing the configuration of the detecting component 2. The detecting component 2 includes the differential transformer 34, an AC power source 35, a screw core 36, a phase comparing circuit 37 and a smoothing circuit 38. The differential transformer 34 includes a driving coil 33, a detecting coil 32 and a reference coil 39. To the driving coil 33, an AC voltage is applied by the AC power source 35. The detecting coil 32 is magnetically coupled to the driving coil 33, and disposed on the side of the housing 8. The reference coil 39 is magnetically coupled to the driving coil 33, and differentially connected to the detecting coil 32. The reference coil 39 is disposed in a position where a voltage E2 of the reference coil 39 is not affected by the remaining amount of the toner 7. The driving coil 33 is configured so as to have almost the same winding number as the detecting coil 32 and the reference coil 39 and be at the opposite polarity to the detecting coil 32 and the reference coil 39. Therefore, a voltage E1 of the detecting coil 32 has substantially the same phase as a voltage E0 of the AC power source 35, and shows a value based on the detection distance. The voltage E2 of the reference coil 39 has a substantially reverse phase to the voltage E0 of the AC power source 35.

Mutual inductance M1 between the driving coil 33 and the detecting coil 32 changes depending on the position of the detection auxiliary member 21. The screw core 36 is made of a material having high permeability, and placed between the driving coil 33 and the reference coil 39. Mutual inductance M2 between the driving coil 33 and the reference coil 39 changes depending on the position where the screw core 36 is placed. The mutual inductance M2 is selected based on the maximum detectable distance of the detecting component 2. In the present embodiment, the maximum detectable distance is set to the shortest distance L3 between the movement path C16 of the first outer periphery 16*a* and the detecting surface portion 2*a* of the detecting component 2. A change of the detection distance L0 appears as a change of the mutual inductance M1. The detecting component 2 detects the change of the mutual inductance M1 as the detection voltage.

To the phase comparing circuit 37, information showing a differential voltage E3 that is the difference between the voltage E1 of the detecting coil 32 and the voltage E2 of the reference coil 39, and information showing the voltage E0 of the AC power source 35 are given. The phase comparing circuit 37 compares the phases of values based on the given information, calculates an exclusive OR, and gives information based on the calculated value to the smoothing circuit 38. The smoothing circuit 38 smoothes the value based on the given information, and outputs as a detection voltage V1.

Figure 8:
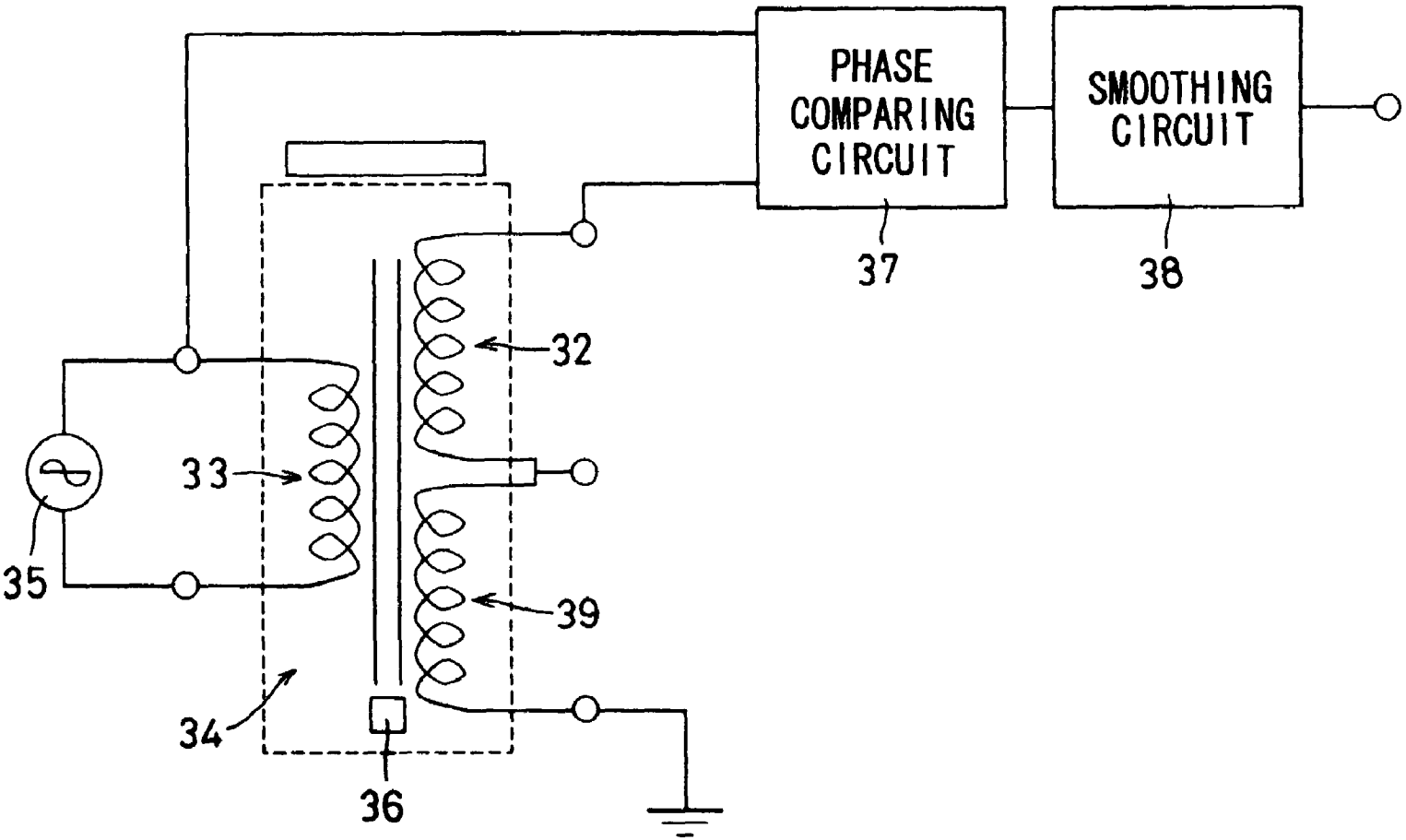
FIG. 8 is an electric circuit diagram showing the configuration of the remaining amount of toner detecting portion 23.

FIG. 8 is an electric circuit diagram showing the configuration of the toner density detecting portion 23. The toner density detecting portion 23 is realized by the same configuration as the detecting component 2 shown in FIG. 7 mentioned before. Therefore, the components of the toner density detecting portion 23 will be denoted by the same reference numerals as the corresponding components in the detecting component 2, only different components will be described, and the description of the same components will be omitted. A detecting surface portion of the toner density detecting portion 23 is placed in a position facing the developing roller 20, spaced from the developing roller. The mutual inductance M1 between the driving coil 33 and the detecting coil 32 changes based on the toner density of the developer adhering to the developing roller 20, because the developer contains the carrier having magnetism. Therefore, information showing the toner density voltage detected based on the toner density is given to the comparator 27. Accordingly, the toner density detecting portion 23 can detect the toner density of the developer.

Figure 9:
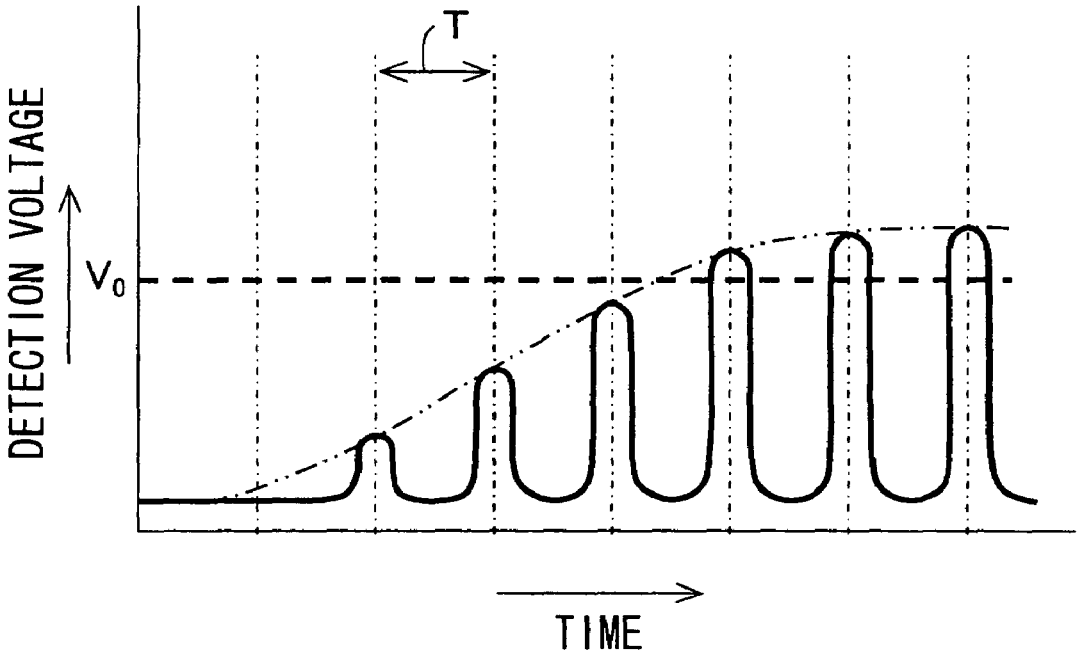
FIG. 9 is a graph showing the relation between time and the detection voltage used in a first detection procedure.

FIG. 9 is a graph showing the relation between time and the detection voltage used in a first detection procedure. The horizontal axis of the graph shows time, and the vertical axis of the graph shows the detection voltage. The first detection means is an example of a procedure for notifying the operator of the remaining amount of the toner.

The detection auxiliary member 21 passes through the detection position of the detecting component 2 at each stirring period T of the stirring member 11. Therefore, the detecting component 2 detects the detection voltage based on the detection distance L0. Since the detection distance L0 becomes small when the remaining amount of the toner decreases as time elapses, the detection voltage becomes large. The detection voltage V0 when the remaining amount of the toner is a predetermined reference amount, for example, the remaining amount of the toner is 30% of the initial amount of the toner is previously found. In the first detection procedure, when the detection voltage becomes larger than the previously found detection voltage V0, notification by the notifying portion 31 is made.

In the first detection procedure, when the remaining amount of the toner is equal to or less than a predetermined reference amount, the notifying portion 31 gives notice that the remaining amount of the toner is equal to or less than the predetermined reference amount. Consequently, the operator can confirm that the remaining amount of the toner is equal to or less than the reference amount. Therefore, the operator can recognize based on the aforementioned notification that time to replenish the housing 8 with toner has come.

FIG. 10 is a simplified cross section view showing the configuration of the image forming apparatus 60 equipped with the developing apparatus 1 of the first embodiment. The image forming apparatus 60 forms an image on a transfer sheet by the use of the electrophotographic method. The image forming apparatus 60 includes an exposing scanning portion 61, an image forming portion 62 and a central controlling portion 63. Moreover, the image forming portion 62 includes the developing apparatus 1 of the first embodiment mentioned before. The image forming apparatus 60 is configured so that the exposing scanning portion 610 can make an angular displacement with respect to the image forming portion 62. In concrete, the image forming apparatus 60 is configured so as to have a clamshell structure, and configured so as to have a rotating portion 64 at one ends in the width direction of the exposing scanning portion 61 and the image forming portion 62 and be capable of making an angular displacement around the axial line of the rotating portion 64. Therefore, in the image forming apparatus 60, it is possible to easily repair trouble such as a transfer sheet jam caused inside.

The central controlling portion 63 is connected to a host computer or the like, generates image information based on image signals given from the host computer, and gives the image information to the exposing scanning portion 61.

The exposing scanning portion 61 includes a laser diode 65, a collimating lens 66, a polygon motor 67, a polygon mirror 68, an fθ lens 69 and a return mirror 70. The exposing scanning portion 61 irradiates the photoreceptor drum 4 composing the image forming portion 62 with a laser beam based on the image information given from the central controlling portion 63. The laser diode 65 emits a laser beam to the collimating lens 66 based on the image information given from the central controlling portion 63. The collimating lens 66 transmits and collimates the laser beam of divergent light, and guides to the polygon motor 67. The polygon mirror 68 is rotated at a constant rotation speed by the polygon motor 67. A plurality of polygon mirrors 68 are disposed so that mirror surfaces reflecting light are in parallel to the rotation axial line. The polygon mirrors 68 polarize the guided laser beam at equiangular velocity, and guide to the fθ lens 69. The fθ lens 69 compensates the guided laser beam so as to be polarized at equiangular velocity on the photoreceptor drum 4, and guides to the return mirror 70. The return mirror 70 reflects the guided laser beam to expose and scan the surface of the photoreceptor drum 4.

The image forming portion 62 includes the photoreceptor drum 4, a cleaner 71, an eraser lamp 72, an electrifying charger 73, the developing apparatus 1, a conveying belt 74, a transferring charger 75, a paper cassette, a paper feeding roller 77, a pair of timing rollers 78, a fixing apparatus 79, a pair of discharging rollers 80 and a paper discharging tray 81. On the surface of the photoreceptor drum 4, a photoconductor is provided. The cleaner 71 removes toner adhering to the surface of the photoreceptor drum 4 before the photoreceptor drum 4 is exposed and scanned. After the cleaner 71 removes the toner, the eraser lamp 72 irradiates the surface of the photoreceptor drum 4 with light and eliminates electricity charged on the photoconductor. The electrifying charger 73 uniformly charges the photoconductor after the eraser lamp 72 eliminates electricity. The photoreceptor drum 4 is exposed and scanned by the exposing scanning portion 61 after being uniformly charged by the electrifying charger 73 in this manner. Accordingly, an electrostatic latent image based on the image information is formed on the surface of the photoreceptor drum 4. The formed electrostatic latent image is developed by the developing portion 6 composing the developing apparatus 1. Accordingly, a toner image is formed on the surface of the photoreceptor drum 4. The developing apparatus 1 includes the developing portion 6 and the toner cartridge 3. The toner cartridge 3 is installed in the image forming apparatus 60 so as to be attached thereto and detached therefrom. Since the image forming apparatus 60 is equipped with the developing apparatus 1, it is possible to detect the remaining amount of the toner in the housing 8. The operator can remove the toner cartridge 3 with a small remaining amount of the toner from the image forming apparatus 60, and installs a new toner cartridge 3 in which the toner 7 is sufficiently stored into the housing 8, thereby replacing the toner cartridge 3, and replenishing with toner. The detecting component 2 is disposed so as to abut against the outer surface of the lower portion of the housing 8 of the toner cartridge 3 when the toner cartridge 3 is installed in the image forming apparatus 60.

A transfer sheet on which an image is formed is previously placed in the paper cassette 76. The transfer sheet is conveyed from the paper cassette 76 to a predetermined transfer position on the photoreceptor drum 4 by the paper feeding roller 77 and the pair of timing rollers 78. The transferring charger 75 is disposed on the opposite side to the photoreceptor drum 4 with respect to a conveying path that the transfer sheet is conveyed to the transfer position. The transferring charger 75 transfers a toner image formed on the photoreceptor drum 4 onto the surface of the transfer sheet. The transfer sheet after transfer is conveyed to the fixing apparatus 79 by the conveying belt 74. The fixing apparatus 79 pressurizes the transfer sheet at high temperatures, fixes toner to the transfer sheet, and conveys to the pair of discharging rollers 80. The pair of discharging rollers 80 convey the transfer sheet to the paper discharging tray 81, and the transfer sheet on which the image is formed is stored into the paper discharging tray 81.

Figure 11:
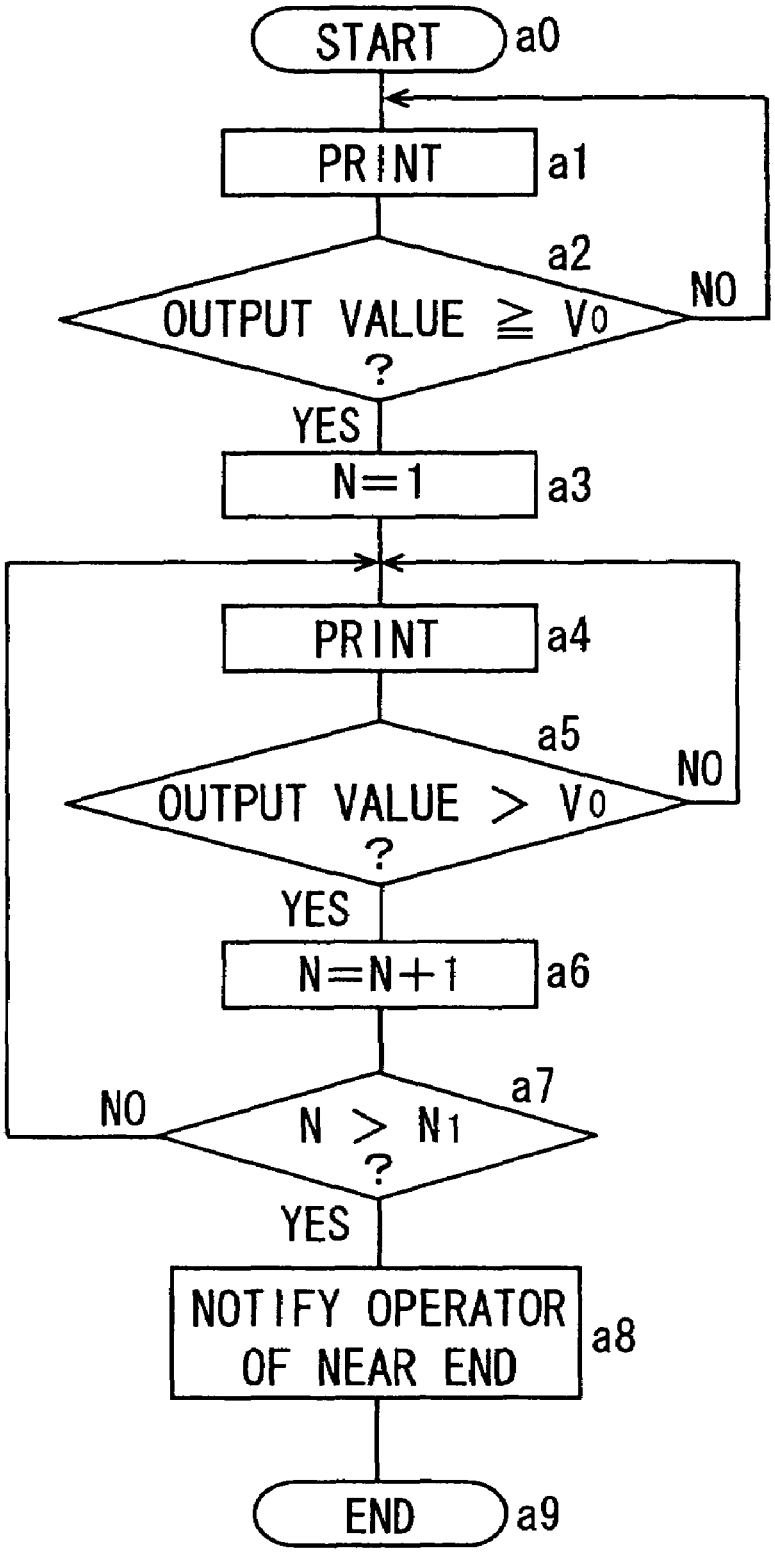
FIG. 11 is a flowchart showing a second detection procedure.

FIG. 11 is a flowchart showing a second detection procedure. The second detection means is an example of a procedure for notifying the operator of the remaining amount of the toner, and different from the aforementioned first detection means. At step a0, when the operator operates an operation portion (not shown), an image forming command to form an image is given to the CPU 24, and the second detection procedure starts, and the procedure goes to step a1. At step a1, the CPU 24 controls the image forming apparatus 60 based on the given image forming command, a printing process to form an image on a transfer sheet is performed, and the toner 7 in the developing portion 6 is consumed, and the procedure goes to step a2. When the toner density of the developing portion 6 becomes equal to or less than a predetermined value, the CPU 24 gives the toner resupply roller 13 a command to resupply the toner 7 from the toner cartridge 3, and the toner 7 is resupplied from the developing portion 6. At step a2, when the toner 7 is resupplied to the developing portion 6, the detecting component 2 detects the detection voltage V1 that is an output voltage based on the detection distance. The CPU 24 compares the detection voltage V1 detected by the detecting component 2 with the predetermined detection voltage V0, and the procedure goes back to step a1 in the case where the detection voltage V1 is smaller than the detection voltage V0, whereas the procedure goes to step a3 in the case where the detection voltage V1 is equal to or more than the detection voltage V0. At step a3, the CPU 24 substitutes an initial value 1 for a number of times N, and the procedure goes to step a4.

At step a4, in the same manner as at step a1, the image forming apparatus 60 performs the printing process based on the image forming command, and the toner 7 is consumed, and the procedure goes to step a5. At step a5, in the same manner as at step a2, the CPU 24 compares the detection voltage V1 with the predetermined detection voltage V0, and the procedure goes back to step a4 in the case where the detection voltage V1 is smaller than the detection voltage V0, whereas the procedure goes to step a6 in the case where the detection voltage V1 is equal to or more than the detection voltage V0. At step a6, the CPU 24 substitutes N+1 for the number of times N to increase the number of times by 1, and the procedure goes to step a7. At step a7, the CPU 24 compares the number of times N with a predetermined number of times N1, and the procedure goes back to step a4 in the case where the number of times N is larger than the number of times N1, whereas the procedure goes to step a8 in the case where the number of times N is equal to or less than the number of times N1. Since the number of times N1 is in inverse proportion to the remaining amount of the toner 7, the number of times N1 is selected based on a predetermined remaining amount of the toner 7. At step a8, the notifying portion 31 notifies the operator of a near end, which is a state where the remaining amount of the toner 7 in the toner cartridge 3 is small, and the procedure goes to step a9, where the present flowchart is ended.

In the second detection procedure, the notifying portion 31 can notify the operator that the remaining amount of the toner is small. Consequently, the operator can recognize that time to replenish with the toner 7 has come, based on the remaining amount of the toner 7. Moreover, by the use of the second detection procedure, the remaining amount of the toner may be detected by counting the number of rotations of the toner resupply roller 13 from the time when the detection voltage V1 is determined to be equal to or more than the detection voltage V0. Moreover, by the use of the second detection means, the remaining amount of the toner may be detected by counting the number of pixels used for image formation from the time when the detection voltage V1 is determined to be equal to or more than the detection voltage V0.

Figure 12:
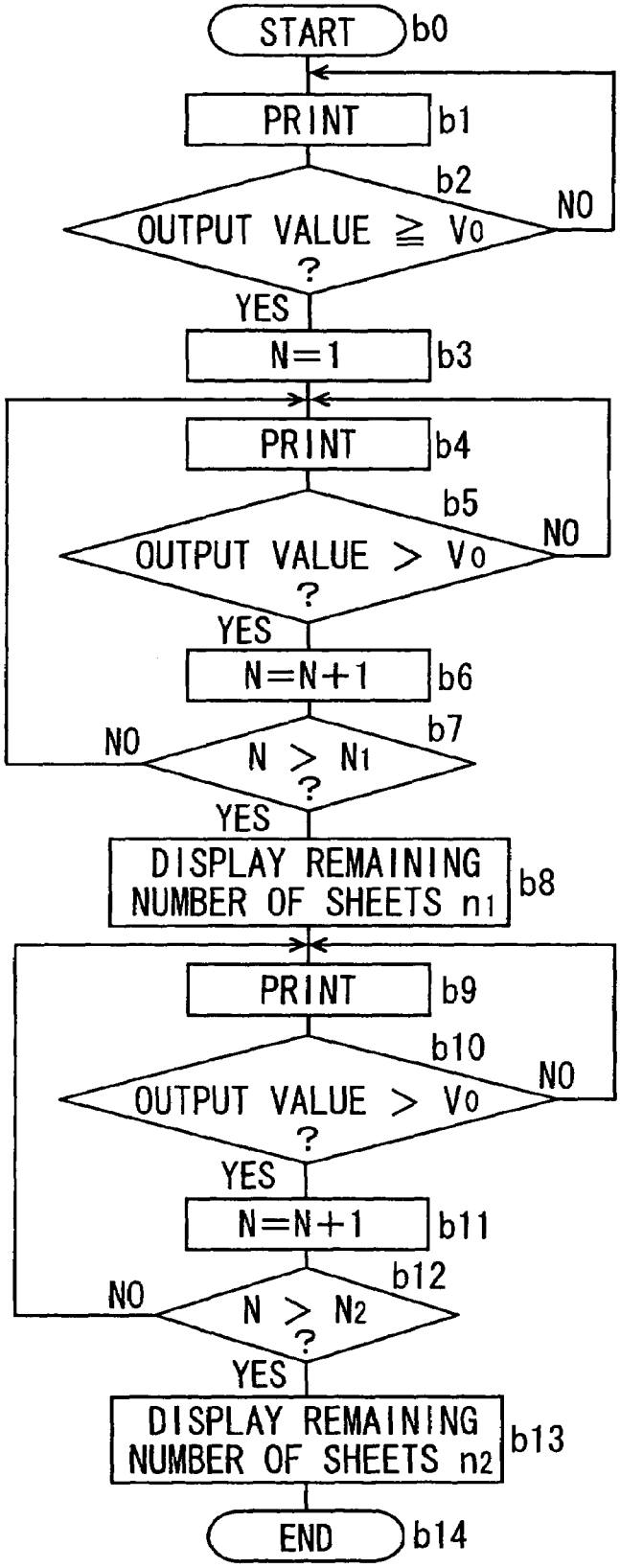
FIG. 12 is a flowchart showing a third detection procedure.
Figure 13:
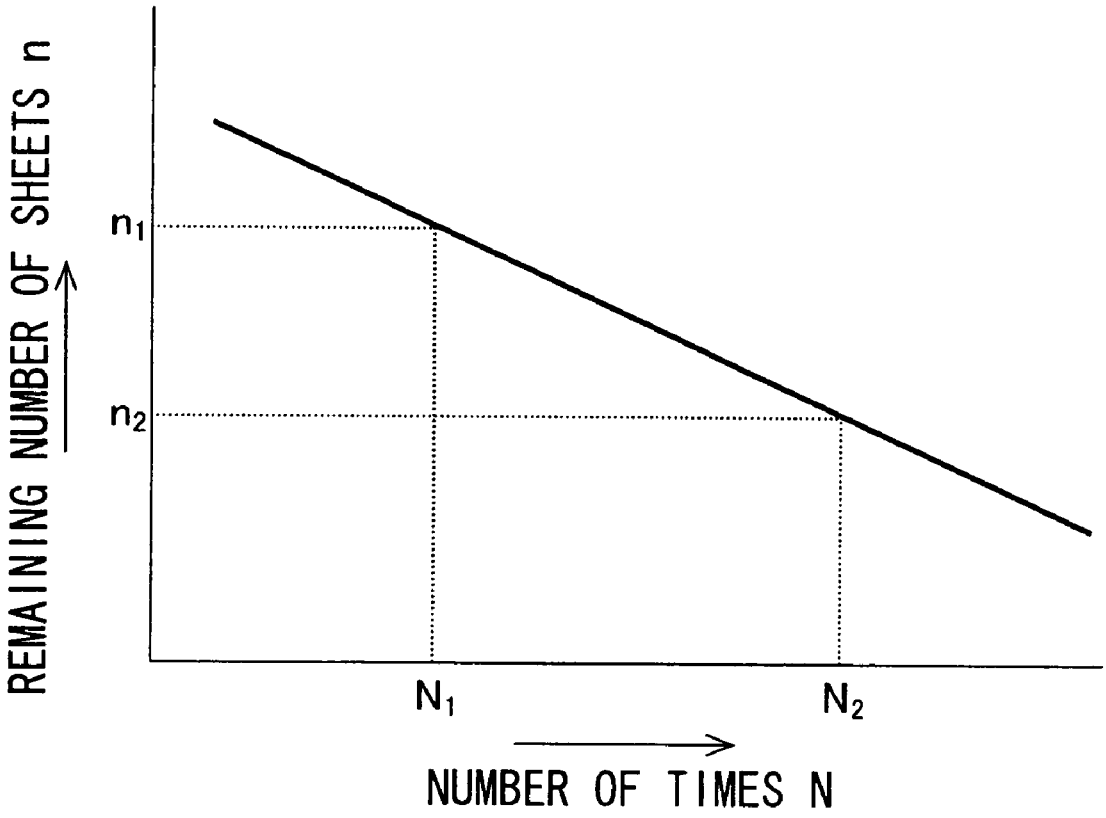
FIG. 13 is a graph showing the relation between the number of times N and a remaining number of sheets n.

FIG. 12 is a flowchart showing a third detection procedure. FIG. 13 is a graph showing the relation between the number of times N and a remaining number of sheets n. The horizontal axis of the graph shows the number of times N, and the vertical axis of the graph shows the remaining number of sheets n that is a remaining number of printable sheets. The third detection means is an example of a procedure for notifying the operator of the remaining amount of the toner, and different from the aforementioned first and second detection means. Since the respective processes at steps b0 to b7 in the present flowchart are similar to the respective processes at steps a0 to a7 in FIG. 11 mentioned above, the description will be omitted.

At step b8, the notifying portion 31 gives notice of the remaining number of sheets n1 based on the number of times N1 as shown in FIG. 13, and the procedure goes to step b9. Since the number of times N1 is in inverse proportion to the remaining amount of the toner 7, the number of times N1 is selected based on a predetermined remaining amount of the toner 7. When the number of times N increases, the remaining number of sheets n decreases. Therefore, it is possible to find the remaining number of sheets n based on the number of times N. The respective processes performed at steps b9 to b11 are the same processes as the respective processes at steps b4 to b6, and the procedure goes to step b12. At step b12, the CPU 24 compares the number of times N with a number of times N2, and the procedure goes back to step b9 in the case where the number of times N2 is larger, whereas the procedure goes to step b13 in the case where the number of times N is equal to or less than the number of times N2. At step b13, the notifying portion 31 gives notice of a remaining number of sheets n2 based on the number of times N2 as shown in FIG. 13, and the procedure goes to step b14, where the present flowchart is ended.

In the third detection means, the notifying portion 31 gives notice of the number of sheets of images that can be formed with the remaining amount of the toner 7. Consequently, the operator can recognize time to replenish with the toner 7 and the reference amount thereof based on the number of sheets of images that can be formed.

Figure 14:
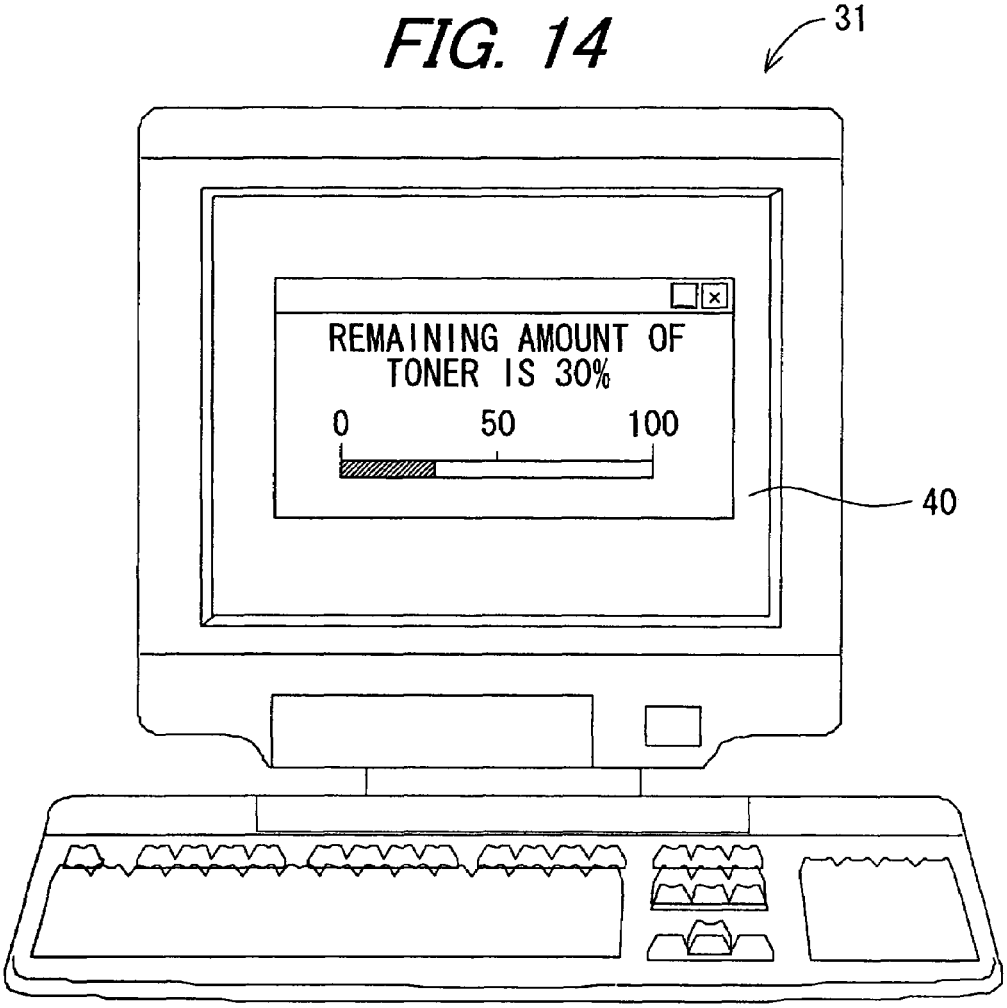
FIG. 14 is a simplified front view showing the notifying portion 31.

FIG. 14 is a simplified front view showing the notifying portion 31. The notifying portion 31 is realized by a display screen 40 in the present embodiment. To the notifying portion 31, a command from the CPU 24 is given, and the notifying portion gives notice of the remaining amount of the toner based on the command. In the case where the remaining amount of the toner based on the command is, for example, 30%, the notifying means gives notice by displaying letters, for example, "the remaining amount of the toner is 30%," and displays also by using a bar graph or the like so that the operator can visually understand with ease. Since the notifying portion 31 gives notice of information on the calculated remaining amount of the toner, the operator can easily check the remaining amount of the toner 7. Therefore, the operator can estimate time to replenish with toner and the replenishment reference amount based on the notified remaining amount of the toner 7, and can replenish the housing 8 with the toner 7 before toner is exhausted from the housing 8.

The developing apparatus 1 includes a remaining amount of toner detecting apparatus. The remaining amount of toner detecting apparatus includes the detection auxiliary member 21, the stirring member 11, the holding member 22, the detecting component 2 and the CPU 24. The remaining amount of toner detecting apparatus is capable of detecting the remaining amount of the toner stored in the housing 8.

In the present embodiment, when at least the first outer periphery 16*a* of the stirring member 11 rotationally moves in the toner layer 7A stored in the housing 8, the first outer periphery 16*a* of the stirring member 11 rotates by pushing the toner layer 7A aside, and forms the movement path C16 in the toner layer 7A. Since the holding member 22 connected to the first outer periphery 16*a* of the stirring member 11 is flexible, when the stirring member 11 rotates in the toner layer 7A stored in the housing 8, the holding member 22 can rotationally move smoothly while bending along the movement path C16 formed in the toner layer 7A by the first outer periphery 16*a* of the stirring member 11 and keeping the same rotation radius as the rotation radius R16*a* of the first outer periphery 16*a*. Therefore, at this moment, the detection auxiliary member 21 held by the holding member 22 can rotationally move smoothly along the movement path C16 formed in the toner layer 7A by the first outer periphery 16*a* of the stirring member 11 while keeping the same rotation radius as the rotation radius R16*a* of the first outer periphery 16*a*. Moreover, when the amount of the toner 7 stored in the housing 8 decreases and the stirring member 11 cannot rotate in the toner layer 7A, the movement path is not formed in the toner 7. At this moment, since the holding member 22 connected to the first outer periphery 16*a* of the stirring member 11 is flexible, the detection auxiliary member 21 increases the rotation radius due to the empty weight, and rotationally moves with a rotation radius larger than that of the first outer periphery 16*a*of the stirring member 11, like rotationally moving on the upper surface of the toner layer 7A while being in contact therewith.

When at least the first outer periphery 16*a* of the stirring member 11 rotates in the toner layer 7A stored in the housing 8, the detection auxiliary member 21 rotationally moves while keeping a fixed rotation radius as mentioned before, so that the distance to the detection auxiliary member 21 detected by the detecting component 2 is fixed. Moreover, when the amount of the toner 7 stored in the housing 8 decreases and the stirring member 11 cannot rotate in the toner layer 7A, the detection auxiliary member 21 rotationally moves with a rotation radius larger than that of the first outer periphery 16*a* of the stirring member 22 as mentioned before, so that the distance to the detection auxiliary member 21 detected by the detecting component 2 becomes small as the amount of the toner 7 decreases and the upper surface 7*b* of the toner layer 7A goes downward.

For example, when the detected distance to the detection auxiliary member 21 is fixed, the CPU 24 determines that the amount of the toner stored in the housing 8 is more than a specified reference amount. Moreover, for example, when the distance to the detection auxiliary member 21 detected being fixed becomes small, the CPU 24 determines that the amount of the toner stored in the housing 8 is the specified reference amount or less, and calculates the remaining amount. Thus, the CPU 24 can detect the remaining amount of the toner 7 stored in the housing 8. Therefore, it is possible to highly accurately detect the remaining amount of the toner 7 with such a simple configuration.

Further, in the present embodiment, the detecting component 2 detects the distance to the detection auxiliary member 21 based on a change of the magnetic field in the detection position by the detection auxiliary member 21. Consequently, when the detecting component 2 detects the distance to the detection auxiliary member 21, the existence of the detection auxiliary member 21 does not hinder rotation of the stirring member 11 or change of the position of the detection auxiliary member 21 based on the remaining amount of the toner 7. Therefore, it is possible to realize highly accurate detection of the remaining amount of the toner 7.

Further, in the present embodiment, the length A22 between both the ends of the holding member 22 is one half or less of the circumference of a circle whose radius is the distance from the rotation center of the stirring member 11 to the first outer periphery 16*a*. For example, in the case where the holding member 22 is placed more upward than the stirring member 11 and more upward than the toner layer 7A, the other end 22*b* in the longitudinal direction of the holding member 22 hangs down due to the weight of the detection auxiliary member 21. By making the length A22 between both the ends of the holding member 22 one half or less of the circumference of a circle whose radius is the distance from the rotation center of the stirring member 11 to the first outer periphery 16*a*, it is possible to prevent the other end 22*b* in the longitudinal direction of the holding member 22 from being wound around the rotation center of the stirring member 11 as far as possible while the stirring member 11 is rotating. Moreover, setting the length A22 between both the ends of the holding member 22 so as to be in the aforementioned length range is preferable for that when the stirring member 11 rotates in the toner layer 7A, the holding member 22 rotationally moves smoothly while bending along the movement path C16 formed in the toner layer 7A by the first outer periphery 16*a* of the stirring member 11 and keeping the same rotation radius as the rotation radius R16*a* of the first outer periphery 16*a*. Consequently, it is possible to prevent the detection auxiliary member 21 from being undesirably displaced. Accordingly, it is possible to highly accurately and securely detect the remaining amount of the toner 7.

Further, in the present embodiment, the maximum detectable distance of detectable distances to the detection auxiliary member 21 by the detecting component 2 is smaller than the distance between the movement path C16 of the first outer periphery 16*a* and the detecting component 2 when the stirring member 11 is rotated. Consequently, for example, the amount of the toner 7 stored in the housing 8 decreases, the stirring member 11 cannot rotate in the toner layer 7A, and the detection auxiliary member 21 rotationally moves outside the movement path C16 of the first outer periphery 16*a* of the stirring member 11, so that the detecting component 2 can detect the distance to the detection auxiliary member 21 on this occasion. Moreover, when the toner 7 is sufficiently stored in the housing 8, that is, when at least the first outer periphery 16*a* of the stirring member 11 rotationally moves in the toner layer 7A stored in the housing 8, the detection auxiliary member 21 rotationally moves along the movement path C16 formed in the toner layer 7A by the first outer periphery 16*a* of the stirring member 11 while keeping the same rotation radius as the rotation radius R16*a* of the first outer periphery 16*a*, so that the detecting component 2 does not detect the detection auxiliary member 21 on this occasion. Therefore, it is possible to prevent the detecting component 2 from unnecessarily performing a detecting operation when the toner 7 is sufficiently stored in the housing 8, and detect the remaining amount of the toner 7 with high accuracy.

Figure 15:
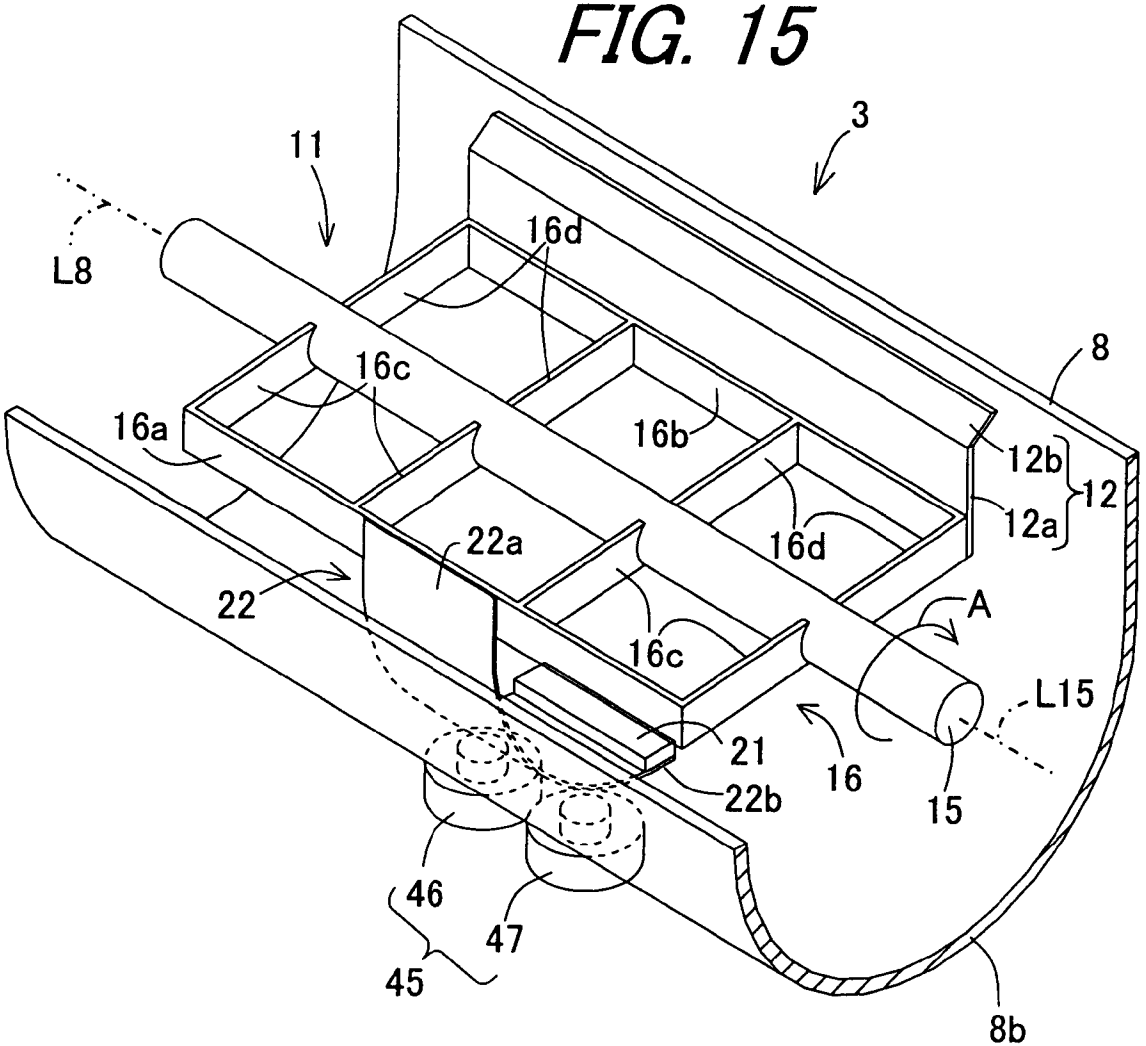
FIG. 15 is a perspective view showing a detecting component 45 and part of the toner cartridge 3 composing a developing apparatus according to a second embodiment of the invention.

FIG. 15 is a perspective view showing a detecting component 45 and part of the toner cartridge 3 composing a developing apparatus according to a second embodiment of the invention. Since the present embodiment is similar to the developing apparatus 1 of the first embodiment mentioned before, the components of the present embodiment will be denoted by the same reference numerals as the corresponding components in the developing apparatus 1, only different components will be described, and the description of the same components will be omitted.

The detecting component 45 serving as the detecting means includes a plurality of, in the present embodiment, two detecting portions, that is, a first detecting portion 46 and a second detecting portion 47. The respective detecting portions 46, 47 are realized by the same configuration as the detecting component 2 of the first embodiment. The respective detecting portions 46, 47 are placed side by side in the direction of the stirring axial line L15 in the present embodiment. The maximum detectable distances of detectable distances to the detection auxiliary member 21 by the respective detecting portions 46, 47 are different from each other. The respective detecting portions 46, 47 are placed so that the distances from the movement path C16 of the first outer periphery 16*a* to the respective detecting portions 46, 47 become equal to each other.

The detection auxiliary member 21 is made of a material having at least one of magnetism and electrical conductivity, and formed like a rectangular plate, for example. In detail, in the detection auxiliary member 21, the dimension in the longitudinal direction is set to a dimension such that the first and second detecting portions 46, 47 can detect the distances to the detection auxiliary member 21, for example, may be set so as to be equal to or more than at least the interval in the direction of the stirring axial line L15 between the first detecting portion 46 and the second detecting portion 47. The holding member 22 is made of, for example, a polymeric material such as PET, and formed like a substantially rectangular film such that assuming a flexible side thereof is the longitudinal direction, the dimension in the width direction perpendicular to the longitudinal direction is a dimension enough to stably hold the detection auxiliary member 21, for example, a dimension equal to the dimension in the longitudinal direction of the detection auxiliary member 21. The thickness of the detection auxiliary member 21 and the thickness of the holding member 22 in the present embodiment are set so as to be the same as the thickness of the detection auxiliary member 21 and the thickness of the holding member 22 in the first embodiment.

The one end 22*a* in the longitudinal direction of the holding member 22 is connected to the first outer periphery 16*a* of the stirring wing portion 16 of the stirring member 11, in the present embodiment, connected to the first outer periphery 16*a* in the middle portion in the direction of the stirring axial line L15. The detection auxiliary member 21 is held by the other end 22*b* in the longitudinal direction of the holding member 22 so that the longitudinal direction becomes substantially parallel to the direction of the stirring axial line L15, and disposed in the housing 8. Since the respective detecting portions 46, 47 are placed side by side in the direction of the stirring axial line L15 in the present embodiment, it is possible to make the distances from the movement path C16 of the first outer periphery 16*a* to the respective detecting portions 46, 47 equal to each other.

Figure 16:
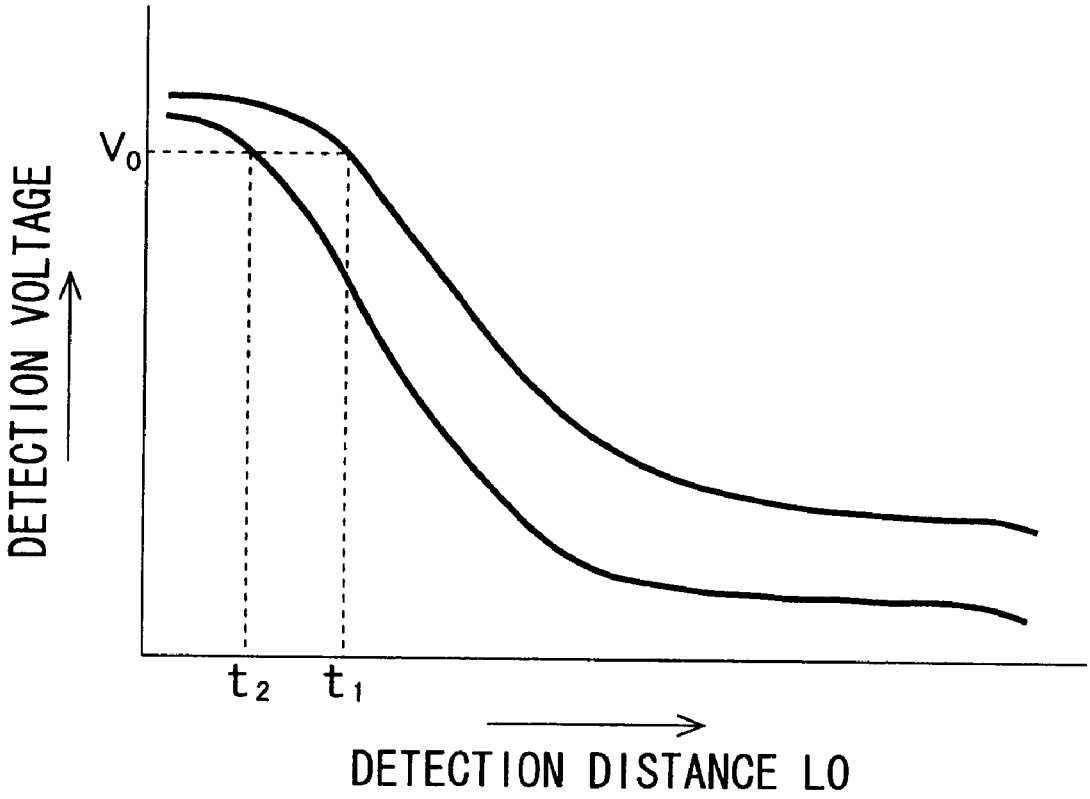
FIG. 16 is a graph showing the relation between the detection distance L0 and detection voltages of the respective detecting portions 46, 47 of the detecting component 45.

FIG. 16 is a graph showing the relation between the detection distance L0 and detection voltages of the respective detecting portions 46, 47 of the detecting component 45. The horizontal axis of the graph shows the detection distance L0, and the vertical axis of the graph shows the detection voltage. The first detecting portion 46 is configured so that the maximum detectable distance thereof becomes longer than that of the second detecting portion 47. Therefore, even if detection voltages V0 detected by the respective detecting portions 46, 47 are the same value, the detection distance L0 corresponding to the detection voltage V0 of the first detecting portion 46 is, for example, a value t1, and the detection distance L0 corresponding to the detection voltage V0 of the second detecting portion 47 is, for example, a value t2. Therefore, the detected detection distances are different. The first detecting portion 46 is capable of detecting the detection auxiliary member 21 earlier than the second detecting portion 47. Since the maximum detectable distances from the detecting component 2 to the detection auxiliary member 21 are thus different depending on the detecting portions, a plurality of distances to the detection auxiliary member 21 that can be detected by the respective detecting portions 46, 47 exist. Therefore, it is possible to detect the distance from the detecting component 2 to the detection auxiliary member 21 plural times in a multistage manner, and also detect the remaining amount of the toner stored in the housing 8 plural times in a multistage manner. Accordingly, it is possible to achieve the same effect as the toner resupply apparatus of the first embodiment mentioned before.

Figure 17:
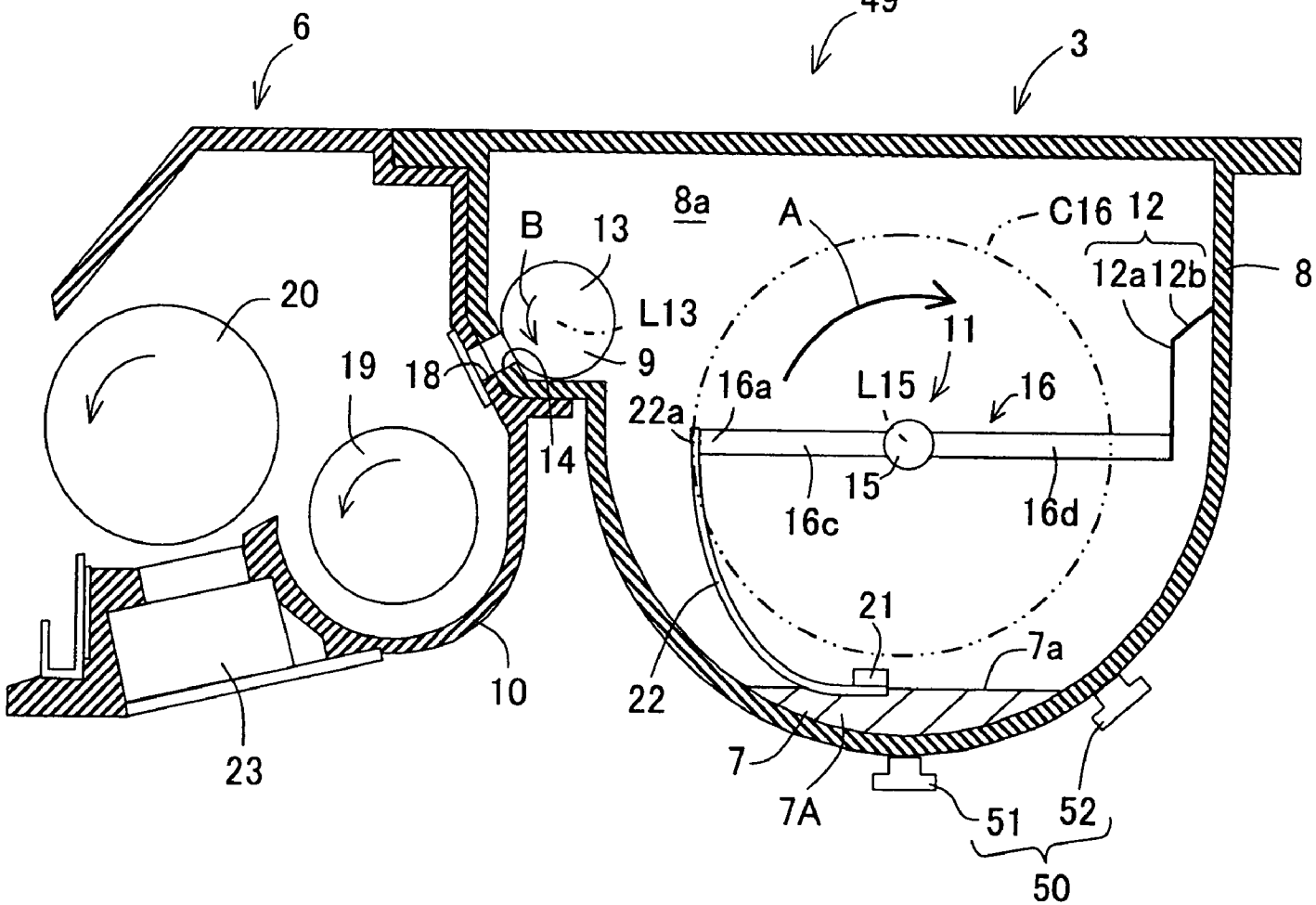
FIG. 17 is a cross section view showing a developing apparatus 49 according to a third embodiment of the invention.
Figure 18:
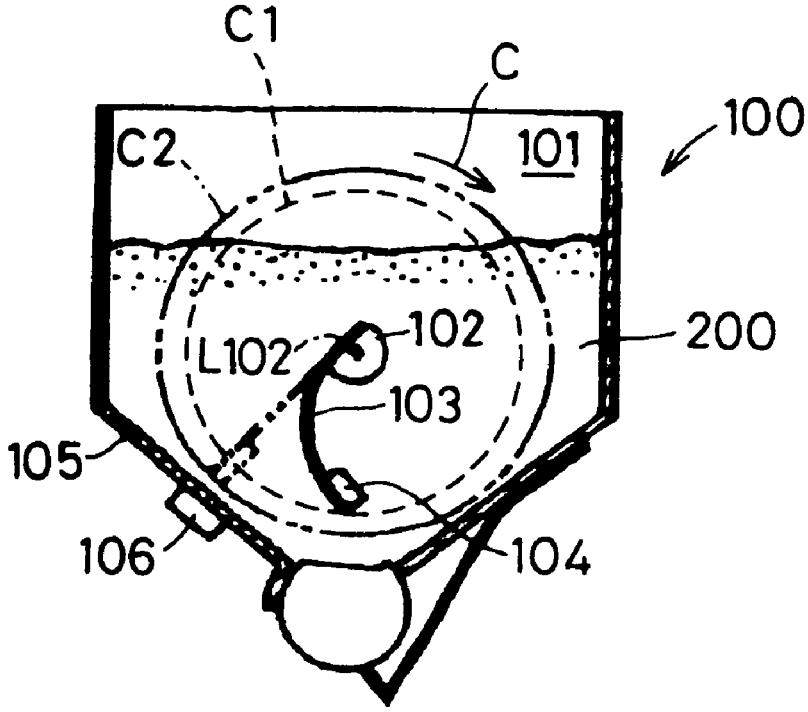
FIG. 18 is a cross section view showing a toner cartridge 100 of a third related art.
Figure 19:
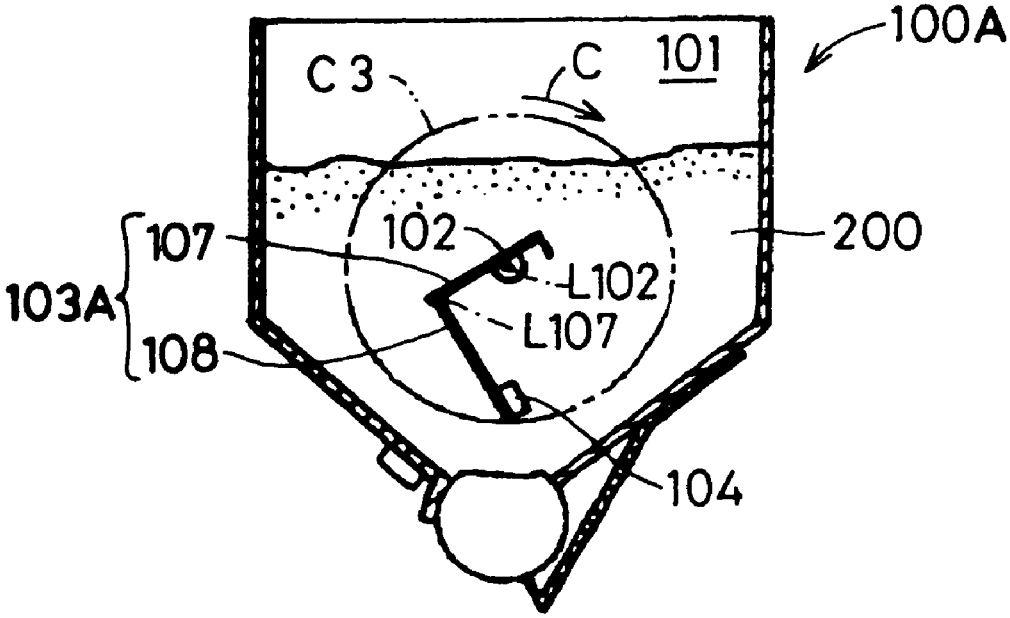
FIG. 19 is a cross section view showing a toner cartridge 100A of a fourth related art.

FIG. 17 is a cross section view showing a developing apparatus 49 according to a third embodiment of the invention. Since the present embodiment is similar to the developing apparatus 1 of the first embodiment mentioned before, the components of the present embodiment will be denoted by the same reference numerals as the corresponding components in the developing apparatus 1, only different components will be described, and the description of the same components will be omitted.

A detecting component 50 serving as the detecting means includes a plurality of, in the present embodiment, two detecting portions, that is, a first detecting portion 51 and a second detecting portion 52. The respective detecting portions 51, 52 are realized by the same configuration as the detecting component 2 of the first embodiment. The respective detecting portions 51, 52 are disposed in different positions with respect to the movement direction of the first outer periphery 16*a* of the stirring member 11. In detail, the second detecting portion 52 is disposed in a position spaced toward the upstream side in the rotation direction A around the stirring axial line L15 of the first outer periphery 16*a* of the stirring member 11 from the first detecting portion 51. In concrete, the first detecting portion 51 is disposed in the same position as the detecting component 2 of the first embodiment, with the result that the respective detecting portions 51, 52 are placed in different positions in the vertical direction, and the first detecting portion 51 locates more downward than the second detecting portion 52.

In the case where the maximum detectable distances of the respective detecting portions 51, 52 are equal to each other, when the upper surface 7*a* of the toner layer 7A in the housing 8 goes downward, firstly by the second detecting portion 52 locating more upward than the first detecting portion 51, the distance from the second detecting portion 52 to the detection auxiliary member 21 moved to the detection position within the maximum detectable distance of the second detecting portion 52 is detected. When the upper surface 7*a* of the toner layer 7A in the housing 8 further goes downward, by the first detecting portion 51 locating more downward than the second detecting portion 52, the distance from the first detecting portion 52 to the detection auxiliary member 21 moved to the detection position within the maximum detectable distance of the first detecting portion 51 is detected. Consequently, it is possible to detect the distance from the detecting component 50 to the detection auxiliary member 21 plural times in a multistage manner, and also detect the remaining amount of the toner 7 stored in the housing 8 plural times in a multistage manner. Therefore, it is possible to achieve the same effect as the developing apparatuses of the first and second embodiments mentioned before.

In the developing apparatuses of the first to third embodiments mentioned before, the configuration of the detection auxiliary member 21 is such that the detection auxiliary member is held by the holding member 22 having flexibility connected to the first outer periphery 16*a* of the stirring member 11, but not limited thereto. For example, the detecting components 2, 45, 50 may be configured so that the detection auxiliary member 21 is displaced based on the remaining amount of the toner 7 in the housing 8 and the distance from the detecting component 2, 45, 50 can be detected. Consequently, it is possible to detect the remaining amount of the toner 7 in the housing 8 without using the holding member 22.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

INDUSTRIAL APPLICABILITY

As described above, according to the invention, the remaining amount of toner detecting apparatus comprises the holding member and the detection auxiliary member. The holding member is flexible, and one end thereof is connected to the outer periphery of the stirring member that rotates and stirs the toner stored in the housing. The detection auxiliary member is held by the other end of the holding member and disposed in the housing. Consequently, the holding member and the detection auxiliary member can rotate with rotation of the stirring member. When at least the outer periphery of the stirring member rotationally moves in the toner layer stored in the housing, the outer periphery of the stirring member rotates by pushing the toner layer aside, and forms a movement path in the toner layer. Since the holding member connected to the outer periphery of the stirring member is flexible, when the stirring member rotates in the toner layer stored in the housing, the holding member can rotationally move smoothly while bending along the movement path formed in the toner layer by the outer periphery of the stirring member and keeping the same rotation radius as the rotation radius of the outer periphery. Therefore, at this moment, the detection auxiliary member held by the holding member can rotationally move smoothly along the movement path formed in the toner layer by the outer periphery of the stirring member while keeping the same rotation radius as the rotation radius of the outer periphery. Moreover, when the amount of the toner stored in the housing decreases and the stirring member cannot rotate in the toner layer, the movement path is not formed in the toner. At this moment, since the holding member connected to the outer periphery of the stirring member is flexible, the detection auxiliary member increases the rotation radius due to the empty weight, and rotationally moves with a rotation radius larger than that of the outer periphery of the stirring member, like rotationally moving on the upper surface of the toner layer while being in contact therewith.

The detecting means is disposed near the lower portion of the housing, and detects the distance to the detection auxiliary member when the detection auxiliary member is rotationally moved by rotation of the stirring member and passes through the detection position. Since the detection auxiliary member rotationally moves while keeping a fixed rotation radius as mentioned before when at least the outer periphery of the stirring member rotates in the toner layer stored in the housing, the distance to the detection auxiliary member detected by the detecting means is fixed. Moreover, when the amount of the toner stored in the housing decreases and the stirring member cannot rotate in the toner layer, the detection auxiliary member rotationally moves with a larger rotation radius than that of the outer periphery of the stirring member as mentioned before, so that the distance to the detection auxiliary member detected by the detecting means becomes small as the amount of the toner decreases and the upper surface of the toner layer goes downward.

The calculating means calculates the remaining amount of the toner based on the distance from the detecting means to the detection auxiliary member. For example, when the detected distance to the detection auxiliary member is fixed, the calculating means determines that the amount of the toner stored in the housing is more than a specified reference amount. Moreover, for example, when the distance to the detection auxiliary member detected being fixed becomes small, the calculating means determines that the amount of the toner stored in the housing is equal to or less than the specified reference amount, and calculates the remaining amount. In this way, the calculating means can detect the remaining amount of the toner stored in the housing. Therefore, it is possible to highly accurately detect the remaining amount of the toner with such a simple configuration.

Further, according to the invention, the detection auxiliary member passes through the predetermined detection position, and thereby changes the magnetic field in the detection position. The detecting means detects the distance to the detection auxiliary member based on the change of the magnetic field in the detection position by the detection auxiliary member. Consequently, when the detecting means detects the distance to the detection auxiliary member, the existence of the detection auxiliary member does not hinder rotation of the stirring member or change of the position of the detection auxiliary member based on the remaining amount of the toner. Therefore, it is possible to realize highly accurate detection of the remaining amount of the toner.

Further, according to the invention, the detection auxiliary member is made of a material having electrical conductivity, so that when the detection auxiliary member passes through the detection position, an eddy current is generated by the magnetic field in the detection position. Due to this eddy current, a magnetic field is generated around the detection auxiliary member. Therefore, the detection auxiliary member can change the magnetic field in the detection position by passing through the detection position. Consequently, the detecting means can detect the distance to the detection auxiliary member passing through the detection position.

Further, according to the invention, the detection auxiliary member is made of a material having magnetism, so that the detection auxiliary member can change the magnetic field in the detecting position when passing through the detection position. Consequently, the detecting means can detect the distance to the detection auxiliary member that passes through the detection position.

Further, according to the invention, the length between both the ends of the holding member is equal to or less than one half of the circumference of a circle whose radius is the distance from the rotation center of the stirring member to the outer periphery. For example, in the case where the holding member is placed more upward than the stirring member and more upward than the toner layer, the other end of the holding member hangs down due to the weight of the detection auxiliary member. By making the length between both the ends of the holding member one half or less of the circumference of a circle whose radius is the distance from the rotation center of the stirring member to the outer periphery, it is possible to prevent the other end of the holding member from being wound around the rotation center of the stirring member as far as possible while the stirring member is rotating. Moreover, setting the length between both the ends of the holding member in the aforementioned length range is preferable for that when the stirring member rotates in the toner layer, the holding member rotationally moves smoothly while bending along the movement path formed in the toner layer by the outer periphery of the stirring member and keeping the same rotation radius as the rotation radius of the outer periphery. Consequently, it is possible to prevent the detection auxiliary member from being undesirably displaced. Accordingly, it is possible to detect the remaining amount of the toner highly accurately and securely.

Further, according to the invention, the maximum detectable distance of detectable distances to the detection auxiliary member by the detecting means is smaller than the distance between the movement path of the outer periphery and the detecting means when the stirring member is rotated. Consequently, for example, the amount of the toner stored in the housing decreases, the stirring member cannot rotate in the toner layer, and the detection auxiliary member rotationally moves outside the movement path of the outer periphery of the stirring member, so that the detecting means can detect the distance to the detection auxiliary member on this occasion. Moreover, when the toner is sufficiently stored in the housing, that is, when at least the outer periphery of the stirring member can rotationally move in the toner layer stored in the housing, the detection auxiliary member rotationally moves along the movement path formed in the toner layer by the outer periphery of the stirring member while keeping the same rotation radius as the rotation radius of the outer periphery, so that the detecting means does not detect the detection auxiliary member on this occasion. Therefore, it is possible to prevent the detecting means from unnecessarily performing a detecting operation when the toner is sufficiently stored in the housing, and detect the remaining amount of the toner with high accuracy.

Further, according to the invention, the detecting means is provided with the plurality of detecting portions whose maximum detectable distances of detectable distances to the detection auxiliarymember are different. Since the maximum detectable distances from the detecting means to the detection auxiliary member differ among the detecting portions, a plurality of distances to the detection auxiliary member that can be detected by the respective detecting portions exist. Therefore, it is possible to detect the distance from the detecting means to the detection auxiliary member plural times in a multistage manner, and also detect the remaining amount of the toner stored in the housing plural times in a multistage manner.

Further, according to the invention, the detecting means is provided with the plurality of detecting portions disposed in different positions with respect to the movement direction of the outer periphery of the stirring member. In the case where the plurality of detecting portions of the detecting means are disposed in different positions with respect to the movement direction of the outer periphery of the stirring member, for example, in positions spaced from each other toward the upstream side in the movement direction of the outer periphery, the respective detecting portions are placed in different positions in the vertical direction. Therefore, as the upper surface of the toner layer in the housing goes downward, the distances from the detecting portions to the detection auxiliary member are detected in the order of detecting portions placed upward. Consequently, it is possible to detect the distance from the detecting means to the detection auxiliary member plural times in a multistage manner, and also detect the remaining amount of the toner stored in the housing plural times in a multistage manner.

Further, according to the invention, notice is given of information on the calculated remaining amount of the toner by the notifying means, so that the operator can easily check the remaining amount of the toner. Therefore, the operator can estimate time to replenish with the toner and the replenishment amount based on the notified remaining amount of the toner, and replenish the housing with the toner before the toner is exhausted from the housing.

Further, according to the invention, when the remaining amount of the toner is the predetermined reference amount or less, notice is given by the notifying means that the remaining amount of the toner is the predetermined reference amount or less. Consequently, the operator can confirm that the remaining amount of the toner is the reference amount or less. Therefore, the operator can recognize based on the aforementioned notification that time to replenish the housing with the toner has come.

Further, according to the invention, notice is given of the number of sheets of images which can be formed by the remaining amount of the toner by the notifying means, so that the operator can recognize the time and reference amount to replenish with the toner based on the number of sheets of formable images.

Further, according to the invention, notice is given of information on the remaining amount of the toner by the notifying means in a multistage manner or in a row in response to the remaining amount of the toner, so that the operator can check the remaining amount of the toner in detail.

Further, according to the invention, the detecting means is realized by a permeability sensor, so that it is possible to detect the distance to the detection auxiliary member.

Further, according to the invention, the toner cartridge is installed in an image forming apparatus so as to be attached thereto and detached therefrom. Moreover, in the toner cartridge, the stirring member is disposed in the housing so as to be capable of rotating, and stirs the toner in the housing by rotating, thereby preventing the toner from cohering. Furthermore, the toner cartridge further comprises the detection auxiliary member and the holding member of the aforementioned remaining amount of toner detecting apparatus, so that, for example, by using the detecting means of the aforementioned remaining amount of toner detecting apparatus, it is possible to detect the distance to the detection auxiliary member. Besides, by using the calculating means of the aforementioned remaining amount of toner detecting apparatus, it is possible to calculate the remaining amount of the toner based on the detected distance. Therefore, in response to the remaining amount of the toner in the housing calculated in this way, the operator can remove a toner cartridge with a small remaining amount of toner from an image forming apparatus, and install a new toner cartridge sufficiently storing toner into the housing, thereby replacing the toner cartridge.

Further, according to the invention, the lower portion of the housing is formed into a curved shape which is convex down with respect to the movement direction of the outer periphery of the stirring member, so that the detection auxiliary member can rotationally move facing the lower portion of the housing when rotationally moving in the lower portion of the housing.

Further, according to the invention, the image forming apparatus comprises the housing in which the toner is stored, and the stirring member disposed in the housing so as to be capable of rotating. Since the stirring member stirs the toner in the housing by rotating, it is possible to prevent the toner from cohering in the housing. Moreover, since the image forming apparatus comprises the aforementioned remaining amount of toner detecting apparatus, it is possible to detect the remaining amount of the toner in the housing.

Further, according to the invention, into the image forming apparatus, the aforementioned toner cartridge is installed so as to be attached thereto and detected therefrom. Moreover, the image forming apparatus is equipped with the detecting means and the calculating means of the aforementioned remaining amount of toner detecting apparatus. Consequently, the image forming apparatus can detect the remaining amount of the toner stored in the toner cartridge.

The invention claimed is:

1. A remaining amount of toner detecting apparatus which detects a remaining amount of toner stored in a housing for storage of toner, the remaining amount of toner detecting apparatus comprising:

a detection auxiliary member disposed in the housing;

a holding member which is flexible and has one end connected to an outer periphery of a stirring member which is rotated to stir the toner in the housing, and another end at which the detection auxiliary member is held;

detecting means disposed near the lower portion of the housing, for detecting a distance from the detecting means to the detection auxiliary member when the detection auxiliary member is moved by rotation of the stirring member and passes through a detection position;

a scraping-out member mounted on to the stirring member such that a cross section perpendicular to an axial line of the stirring member is formed into a substantially V-letter shape, the scraping-out member having a base portion and a free end, the free end elastically abutting against an inner peripheral surface of at least the lower portion of the housing; and calculating means for calculating the remaining amount of the toner based on the distance from the detecting means to the detection auxiliary member.

2. The remaining amount of toner detecting apparatus of claim 1, wherein the detection auxiliary member passes through a predetermined detection position, and thereby a magnetic field in the detection position is changed; and the detecting means detects the distance to the detection auxiliary member based on the change of the magnetic field in the detection position by the detection auxiliary member.

3. The remaining amount of toner detecting apparatus of claim 2, wherein the detection auxiliary member is made of a material having electrical conductivity.

4. The remaining amount of toner detecting apparatus of claim 2, wherein the detection auxiliary member is made of a material having magnetism.

5. The remaining amount of toner detecting apparatus of any one of claims 1 to 4, wherein the length between both ends of the holding member is equal to or less than one half of the circumference of a circle whose radius is the distance from the rotation center of the stirring member to the outer periphery.

6. The remaining amount of toner detecting apparatus of claim 1, wherein the maximum detectable distance of detectable distances to the detection auxiliary member by the detecting means is smaller than the distance between the movement path of the outer periphery and the detecting means when the stirring member is rotated.

7. The remaining amount of toner detecting apparatus of claim 1, wherein the detecting means is provided with a plurality of detecting portions whose maximums of detectable distances to the detection auxiliary member are different.

8. The remaining amount of toner detecting apparatus of claim 1, wherein the detecting means is provided with a plurality of detecting portions disposed in different positions with respect to the movement direction of the outer periphery of the stirring member.

9. The remaining amount of toner detecting apparatus of claim 1, further comprising notifying means for giving notice of information on the calculated remaining amount of the toner.

10. The remaining amount of toner detecting apparatus of claim 9, wherein when the remaining amount of the toner is a predetermined reference amount or less, the notifying means gives notice that the remaining amount of the toner is not more than the predetermined reference amount.

11. The remaining amount of toner detecting apparatus of claim 9, wherein the notifying means gives notice of the number of sheets of images which can be formed of the remaining amount of the toner.

12. The remaining amount of toner detecting apparatus of claim 9, wherein the notifying means gives notice of information on the remaining amount of the toner in a multistage manner or in a row in response to the remaining amount of the toner.

13. The remaining amount of toner detecting apparatus of any one of claims 1 to 12, wherein the detecting means is a permeability sensor.

14. A toner cartridge installed in an image forming apparatus so as to be attached thereto and detached therefrom, the toner cartridge comprising:

a housing for storage of toner;

a stirring member disposed in the housing so as to rotate and stir thereby the toner in the housing;

a detection auxiliary member disposed in the housing;

a holding member which is flexible and has one end connected to the outer periphery of the stirring member, and another end at which the detection auxiliary member is held; and a scraping-out member mounted on to the stirring member such that a cross section perpendicular to an axial line of the stirring member is formed into a substantially V-letter shape, the scraping-out member having a base portion and a free end, the free end elastically abutting against an inner peripheral surface of at least the lower portion of the housing.

15. The toner cartridge of claim 14, wherein the lower portion of the housing is formed into a curved shape which is convex down with respect to the movement direction of the outer periphery of the stirring member.

16. An image forming apparatus comprising:

a housing in which toner is stored;

a stirring member which is disposed in the housing so as to be capable of rotating and stirs the toner in the housing by rotating; and a remaining amount of toner detecting apparatus comprising:

a detection auxiliary member disposed in the housing;

a holding member which is flexible, one end of which is connected to the outer periphery of the stirring member, and the other end of which holds the detection auxiliary member;

detecting means disposed near the lower portion of the housing, for detecting the distance to the detection auxiliary member when the detection auxiliary member is moved by rotation of the stirring member and passes through a detection position;

a scraping-out member mounted on to the stirring member such that a cross section perpendicular to an axial line of the stirring member is formed into a substantially V-letter shape, the scraping-out member having a base portion and a free end, the free end elastically abutting against an inner peripheral surface of at least the lower portion of the housing; and calculating means for calculating the remaining amount of the toner based on the distance from the detecting means to the detection auxiliary member.

17. An image forming apparatus comprising:

an image forming apparatus main unit; and a toner cartridge installed in the image forming apparatus main unit so as to be attached thereto and detached therefrom, the toner cartridge comprising:

a housing in which toner is stored;

a stirring member which is disposed in the housing so as to rotate and stir the toner in the housing;

a detection auxiliary member disposed in the housing; and a holding member which is flexible and has one end connected to the outer periphery of the stirring member, and another end at which the detection auxiliary member is held;

a scraping-out member mounted on to the stirring member such that a cross section perpendicular to an axial line of the stirring member is formed into a substantially V-letter shape, the scraping-out member having a base portion and a free end, the free end elastically abutting against an inner peripheral surface of at least the lower portion of the housing, wherein the image forming apparatus main unit includes:

detecting means disposed near the lower portion of the housing, for detecting the distance to the detection auxiliary member when the detection auxiliary member is moved by rotation of the stirring member and passes through a detection position; and calculating means for calculating the remaining amount of the toner based on the distance from the detecting means to the detection auxiliary member.

* * * * *